US010252517B2

(12) United States Patent
Nakamura et al.

(10) Patent No.: US 10,252,517 B2
(45) **Date of Patent: *Apr. 9, 2019**

(54) IMAGE FORMING APPARATUS AND METHOD FOR CALCULATING ACTUAL DISTANCE OF DEVIATION

(71) Applicants: Kahei Nakamura, Tokyo (JP); Masaya Kawarada, Kanagawa (JP); Kohta Aoyagi, Kanagawa (JP); Suguru Yokozawa, Kanagawa (JP); Nobuyuki Satoh, Kanagawa (JP)

(72) Inventors: Kahei Nakamura, Tokyo (JP); Masaya Kawarada, Kanagawa (JP); Kohta Aoyagi, Kanagawa (JP); Suguru Yokozawa, Kanagawa (JP); Nobuyuki Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/808,820

(22) Filed: Nov. 9, 2017

(65) Prior Publication Data

US 2018/0147835 A1 May 31, 2018

(30) Foreign Application Priority Data

Nov. 25, 2016 (JP) ..... 2016-229569

(51) Int. Cl.
*B41J 2/045* (2006.01)
*B41J 29/393* (2006.01)
(Continued)

(52) U.S. Cl.
CPC ..... *B41J 2/04505* (2013.01); *B41J 2/04586* (2013.01); *B41J 2/2135* (2013.01);
(Continued)

(58) Field of Classification Search
CPC ..... B41J 2/04505; B41J 11/46; B41J 2/2135; B41J 29/13; B41J 29/393; B41J 2/04586
See application file for complete search history.

(56) References Cited

U.S. PATENT DOCUMENTS

2009/0316164 A1 12/2009 Takahashi et al.
2011/0148971 A1 6/2011 Suzuki et al.
(Continued)

FOREIGN PATENT DOCUMENTS

JP 2007-176166 7/2007
JP 2011-131399 7/2011
JP 2016-221719 12/2016

*Primary Examiner* — Henok Legesse
(74) *Attorney, Agent, or Firm* — Duft & Bornsen, PC

(57) ABSTRACT

An image forming apparatus includes an image forming device; an imaging device; and at least one processor including a pattern forming unit to cause a recording head to form a pair of first marks, with first and second nozzles disposed at a first distance from each other in a direction of conveyance of a recording medium, while the recording head moves in a first direction and cause the recording head to form a second mark while the recording head moves in a second direction, a position detector to detect positions of the first and second marks in a captured image, a ratio calculator to calculate a ratio between a distance between the first marks in the captured image and a deviation of the second mark in the captured image, and distance calculator to calculate a distance of the deviation based on the first distance and the ratio.

14 Claims, 25 Drawing Sheets

(51) Int. Cl.

| | |
|---|---|
| ***B41J 29/13*** | (2006.01) |
| ***B41J 2/21*** | (2006.01) |
| ***B41J 11/46*** | (2006.01) |

(52) U.S. Cl.

CPC ..... *B41J 11/46* (2013.01); *B41J 29/13* (2013.01); *B41J 29/393* (2013.01)

(56) References Cited

U.S. PATENT DOCUMENTS

| | | | |
|---|---|---|---|
| 2012/0218568 | A1 | 8/2012 | Yorimoto et al. |
| 2014/0300722 | A1 | 10/2014 | Garcia |
| 2016/0347052 | A1 | 12/2016 | Kawarada et al. |

IMAGE FORMING APPARATUS AND METHOD FOR CALCULATING ACTUAL DISTANCE OF DEVIATION

CROSS-REFERENCE TO RELATED APPLICATIONS

This patent application is based on and claims priority pursuant to 35 U.S.C. § 119(a) to Japanese Patent Application No. 2016-229569, filed on Nov. 25, 2016, in the Japan Patent Office, the entire disclosure of which is hereby incorporated by reference herein.

BACKGROUND

Technical Field

This disclosure relates to an image forming apparatus, a method for calculating an actual distance of deviation, and a computer program product storing the method.

Description of the Related Art

Many inkjet image forming apparatuses repeat discharging ink from a recording head while making a carriage including the recording head reciprocate in a main scanning direction, and conveying a recording medium (an object on which an image is to be formed) in a sub-scanning direction with a conveyance roller in order to form the image.

In such image formation, the amount of conveyance of the recording medium (the amount of the recording medium to be conveyed) may undesirably change depending on the variations in diameter, attachment condition, and eccentricity of the conveyance roller, and the type of the recording medium. The change in the amount of conveyance may cause a deviation of the landing position of ink in the sub-scanning direction. In light of the foregoing, for example, the amount of conveyance may be adjusted as follows. A test pattern is formed on a recording medium, a two-dimensional sensor or the like detects the amount of deviation of the test pattern in the direction of conveyance of the recording medium, and the amount of rotation of the conveyance roller is corrected based on the detected amount of deviation.

However, even after such correction of the amount of conveyance of the recording medium, an inconvenience such as a void or an overlay of excessive ink may occur, reducing the image quality. For example, when there is a difference in inclination of the carriage between forward movement and backward movement of the carriage in the main scanning direction (between when the carriage moves forward and when the carriage moves backward). Additionally, there may also be a difference in inclination of the recording head between the time when the carriage moves forward and the time when the carriage moves backward.

SUMMARY

According to an embodiment of this disclosure, an image forming apparatus includes an image forming device including a recording head to move in a first direction and a second direction opposite the first direction and form a test pattern on a recording medium. The test pattern includes a pair of first marks and a second mark. The recording head includes a plurality of nozzles to discharge ink. The plurality of nozzles includes a first nozzle to form one of the pair of first marks, and a second nozzle disposed at a first distance from the first nozzle in a direction of conveyance of the recording medium, to form the other of the pair of first marks. The image forming apparatus further includes an imaging device to obtain a captured image of the test pattern and at least one processor including a pattern forming unit, a position detector, a ratio calculator, and a distance calculator. The pattern forming unit is configured to cause the recording head to form the pair of first marks while the recording head moves in the first direction and cause the recording head to form the second mark while the recording head moves in the second direction. The position detector is configured to detect a position of the pair of first marks and a position of the second mark in the captured image obtained by the imaging device. The ratio calculator is configured to calculate a ratio between a distance between the pair of first marks in the captured image and a deviation of the second mark in the captured image. The distance calculator is configured to calculate an actual distance of the deviation of the second mark based on the first distance between the first nozzle and the second nozzle and the ratio.

In another embodiment, an image forming apparatus includes an image forming device including a recording head to move in a first direction and a second direction opposite the first direction and form a test pattern on a recording medium. The test pattern includes a pair of first marks and a second mark. The recording head includes a plurality of nozzles to discharge ink, including a first nozzle to form one of the pair of first marks, a second nozzle disposed at a first distance from the first nozzle in a direction of conveyance of the recording medium, the second nozzle to form the other of the pair of first marks, and a third nozzle disposed at a second distance from the first nozzle in the direction of conveyance of the recording medium, to form the second mark. The image forming apparatus further includes an imaging device configured to obtain a captured image of the test pattern, and at least one processor including a pattern forming unit, a position detector, a ratio calculator, and a distance calculator. The pattern forming unit is configured to cause the recording head to form the pair of first marks while the recording head moves in the first direction and cause the recording head to form the second mark while the recording head moves in the second direction. The position detector is configured to detect a position of the pair of first marks and a position of the second mark in the captured image obtained by the imaging device. The ratio calculator is configured to calculate a ratio between a distance between the pair of first marks in the captured image and a distance from one of the pair of first marks to the second mark in the captured image. The distance calculator is configured to calculate an actual distance of a deviation of the second mark based on the first distance, the second distance, and the ratio.

Yet another embodiment provides a method for calculating an actual distance of a deviation, performed in an image forming apparatus. The method includes forming a pair of first marks on recording medium, with a first nozzle and a second nozzle of a recording head, while the recording head moves in a first direction, the first nozzle and the second nozzle disposed at a first distance from each other in a direction of conveyance of the recording medium; forming a second mark on the recording medium while the recording head moves in a second direction opposite the first direction; obtaining a captured image of a test pattern including the pair of first marks and the second mark; detecting a position of the pair of first marks and a position of the second mark in the captured image; and calculating an actual distance of a deviation of the second mark based on a distance between the pair of first marks in the captured image, the position of the second mark in the captured image, and the first distance.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
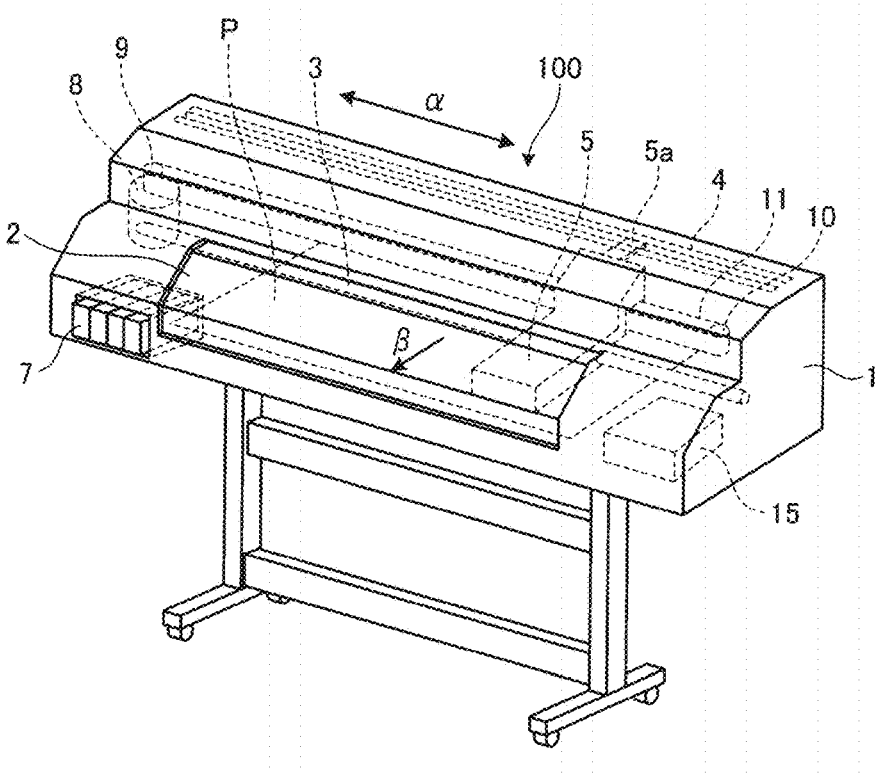
FIG. 1 is a perspective view of an interior of an image forming apparatus according to Embodiment 1.

The accompanying drawings are intended to depict embodiments of the present invention and should not be interpreted to limit the scope thereof The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of this disclosure is described. As used herein, the singular forms "a", "an", and "the" are intended to include the plural forms as well, unless the context clearly indicates otherwise.

Embodiments of an image forming apparatus, a method for calculating an actual distance of deviation, and a program to cause a processor to perform the method will be described in detail referring to the appended drawings.

To suppress fluctuations in the amount of conveyance of a conveyed object, the amount of correction of the amount of conveyance of the conveyed object may be calculated based on the difference between data of an actual position detected by a sensor and data of a theoretical position. However, to adjust an image formation position in accordance with deviation in the landing position of ink due to fluctuations in the amount of conveyance of the recording medium or inclination of the carriage, it is necessary to know the actual amount of deviation of landing position of ink. According to embodiments described below, the actual distance of the deviation of landing position of ink is calculated based on a deviation in an image captured by an imaging unit, and the amount of conveyance of the conveyed object can be corrected for each direction in which a carriage moves.

Note that an inkjet printer configured to discharge ink on a recording medium that is an exemplary object on which an image is to be formed in order to form the image will be described as an exemplary image forming apparatus in the embodiments described below. The image forming apparatus has a function of capturing an image of a test pattern on a recording medium, using the captured image to calculate a distance corresponding to the amount of deviation of the landing position of ink when the deviation of the landing position occurs, and adjusting the parameter associated with the amount of conveyance of the recording medium. However, examples to which aspect of this disclosure are applicable are not limited to the embodiments described below. Aspects of present disclosure can be widely applied to various types of image forming apparatuses configured to capture an image of a test pattern in order to calculate the distance corresponding to the amount of deviation using the captured image. In addition, although a recording medium will be described as an object on which an image is to be formed in the embodiment below, the object include any objet on which an image is to be formed.

Embodiment 1

[Mechanical Configuration of Image Forming Apparatus]

Figure 2:
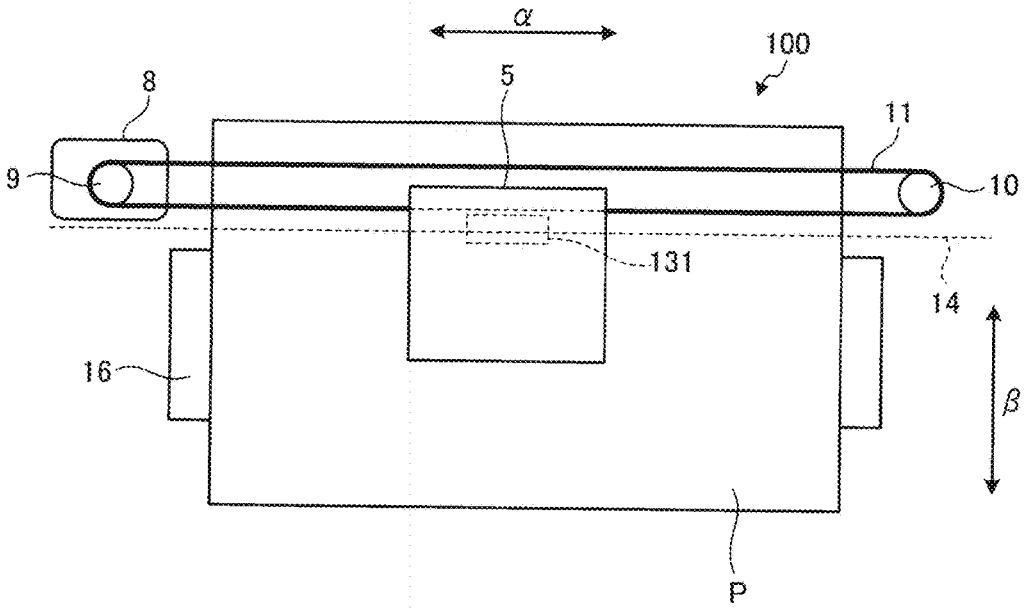
FIG. 2 is a top view of a mechanical configuration of the image forming apparatus according to Embodiment 1.
Figure 3:
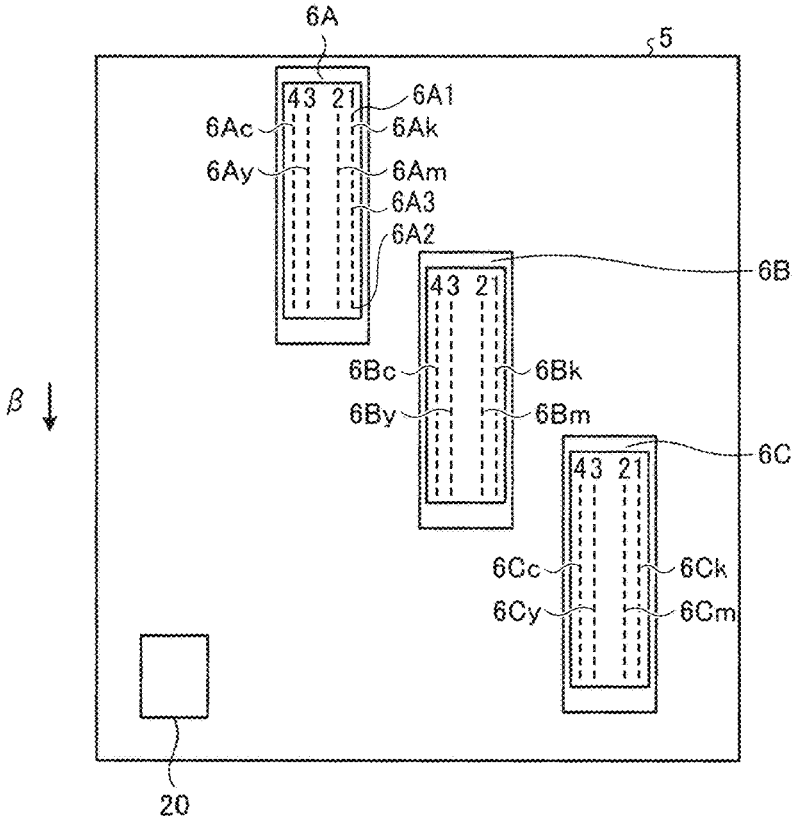
FIG. 3 is a view of a carriage according to Embodiment 1.

An exemplary mechanical configuration of an image forming apparatus 100 will be described first referring to the appended drawings. FIG. 1 is a perspective view of the inside of the image forming apparatus according to Embodiment 1. FIG. 2 is a top view illustrating the mechanical structure inside the image forming apparatus according to Embodiment 1. FIG. 3 is a view of a carriage of the image forming apparatus illustrated in FIG. 1.

As illustrated in FIG. 1, the image forming apparatus 100 according to the present embodiment includes a carriage 5 to reciprocate in a main scanning direction indicated by arrow α in the drawings (hereinafter "direction α"). The carriage 5 is supported by a main guide rod 3 extending in the main scanning direction. In addition, the carriage 5 includes a coupler 5*a*. The coupler 5*a* engages with a sub guide 4 disposed parallel to the main guide rod 3 to stabilize the posture of the carriage 5.

The carriage 5 is coupled to a timing belt 11 extending between a driving pulley 9 and a driven pulley 10. The driving pulley 9 rotates by the driving of the main scanning motor 8. The driven pulley 10 includes a mechanism to adjust the distance with the driving pulley 9 in order to give a predetermined degree of tension to the timing belt 11. The driving of the main scanning motor 8 causes the timing belt 11 to convey the carriage 5. This causes the carriage 5 to reciprocate in the main scanning direction. For example, a main-scanning encoder sensor 131 is disposed on the carriage 5 as illustrated in FIG. 2. The main-scanning encoder sensor 131 detects a mark on an encoder sheet 14 and outputs an encoder value. The travel amount and travel speed of the carriage 5 are controlled based on the encoder value.

The carriage 5 includes recording heads 6A, 6B, and 6C as illustrated in FIG. 3. The recording head 6A includes a nozzle line 6Ay in which many nozzles to discharge yellow (Y) ink are arranged, a nozzle line 6Ac in which many nozzles to discharge cyan (C) ink are arranged, a nozzle line 6Am in which many nozzles to discharge magenta (M) ink are arranged, and a nozzle line 6Ak in which many nozzles to discharge black (K) ink are arranged. Similarly, the recording head 6B includes nozzle lines 6By, 6Bc, 6Bm, and 6Bk. The recording head 6C includes nozzle lines 6Cy, 6Cc, 6Cm, and 6Ck. The subscripts y, m, c, and k attached to reference characters represent colors (yellow, magenta, cyan, and black) and may be omitted when color discrimination is not necessary. Hereinafter, the recording heads 6A, 6B, and 6C will collectively be referred to as recording heads 6. The recording head 6 is supported by the carriage 5 so that a discharge face (nozzle face) of the recording head 6 faces down (toward a recording medium P).

A cartridge 7, from which ink is supplied to the recording head 6, is not mounted on the carriage 5. A cartridge 7 is disposed at a predetermined position in the image forming apparatus 100. The cartridge 7 and the recording head 6 are coupled with a pipe so that ink is supplied through the pipe from the cartridge 7 to the recording head 6.

A platen 16 is disposed at a position facing the discharge face of the recording head 6 as illustrated in FIG. 2. The platen 16 is used to support the recording medium P when ink is discharged from the recording head 6 onto the recording medium P. The platen 16 includes many through holes penetrating in the thickness direction and rib-shaped projections surrounding each of the through holes. The platen 16 includes a suction fan on a face opposite to the face supporting the recording medium P. Activating the suction fan prevents the recording medium P from falling from the platen 16. The recording medium P is held between a conveyance roller pair and intermittently conveyed on the platen 16 in a sub-scanning direction indicated by arrow β illustrated in the drawings (hereinafter "direction β" or "direction of conveyance of the recording medium"). The conveyance roller is driven by a sub-scanning motor 12 to be described below (see FIG. 13).

The recording head 6 includes many nozzles arranged in the sub-scanning direction as described above. The image forming apparatus 100 according to the present embodiment intermittently conveys the recording medium P in the sub-scanning direction. Meanwhile, the image forming apparatus 100 causes the carriage 5 to reciprocate in the main scanning direction, selectively drives the nozzles of the recording head 6 according to the image data, and discharges the ink from the recording head 6 to the recording medium P on the platen 16 while the conveyance of the recording medium P stops in order to record an image on the recording medium P.

The image forming apparatus 100 according to the present embodiment further includes a maintenance mechanism 15 to maintain the reliability of the recording head 6. For example, the maintenance mechanism 15 cleans the discharge face of the recording head 6, puts a cap on the recording head 6, and discharges unnecessary ink from the recording head 6.

The carriage 5 further includes an imaging unit 20 (an imaging device) to capture an image of a test pattern TP on the recording medium P as illustrated in FIG. 3. The test pattern TP will be described below (see FIGS. 16A and 16B). The imaging unit 20 will be described in detail later.

Each of the components described above and included in the image forming apparatus 100 according to the present embodiment is disposed in an enclosure 1. The enclosure 1 includes a cover 2 to open and close. When maintenance of the image forming apparatus 100 is performed or when paper jam occurs, the cover 2 is opened, and work relating to the components in the enclosure 1 can be performed.

In an embodiment, the imaging unit 20 illustrated in FIG. 3 includes a reference chart to be simultaneously captured together with the test pattern TP. In another embodiment, the imaging unit 20 does not include such a reference chart. The reference chart is used to calculate the colorimetric value of the test pattern TP, for example, according to the RGB value of each reference patch (see FIG. 9).

[Example 1 of Imaging Unit]

Figure 4:
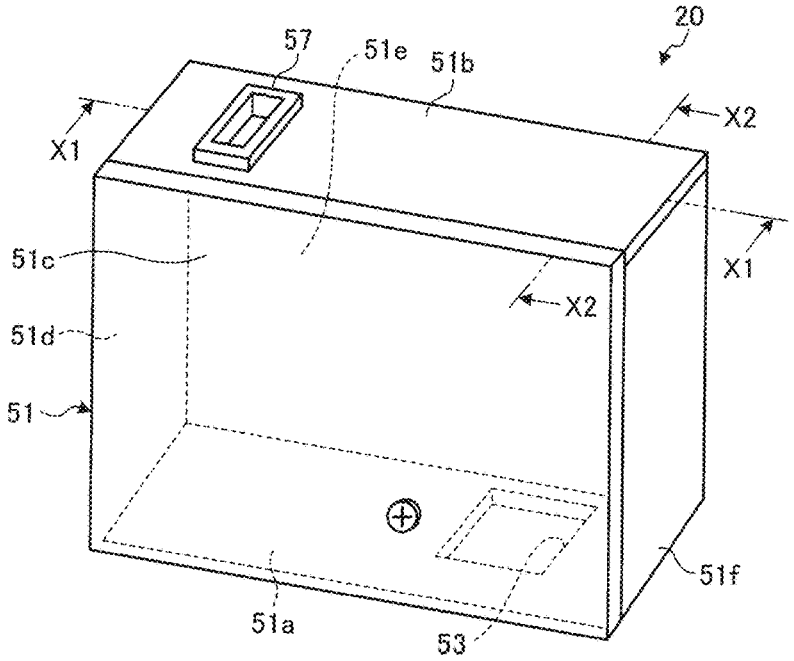
FIG. 4 is a perspective view of an appearance of an imaging unit according to Embodiment 1.
Figure 5:
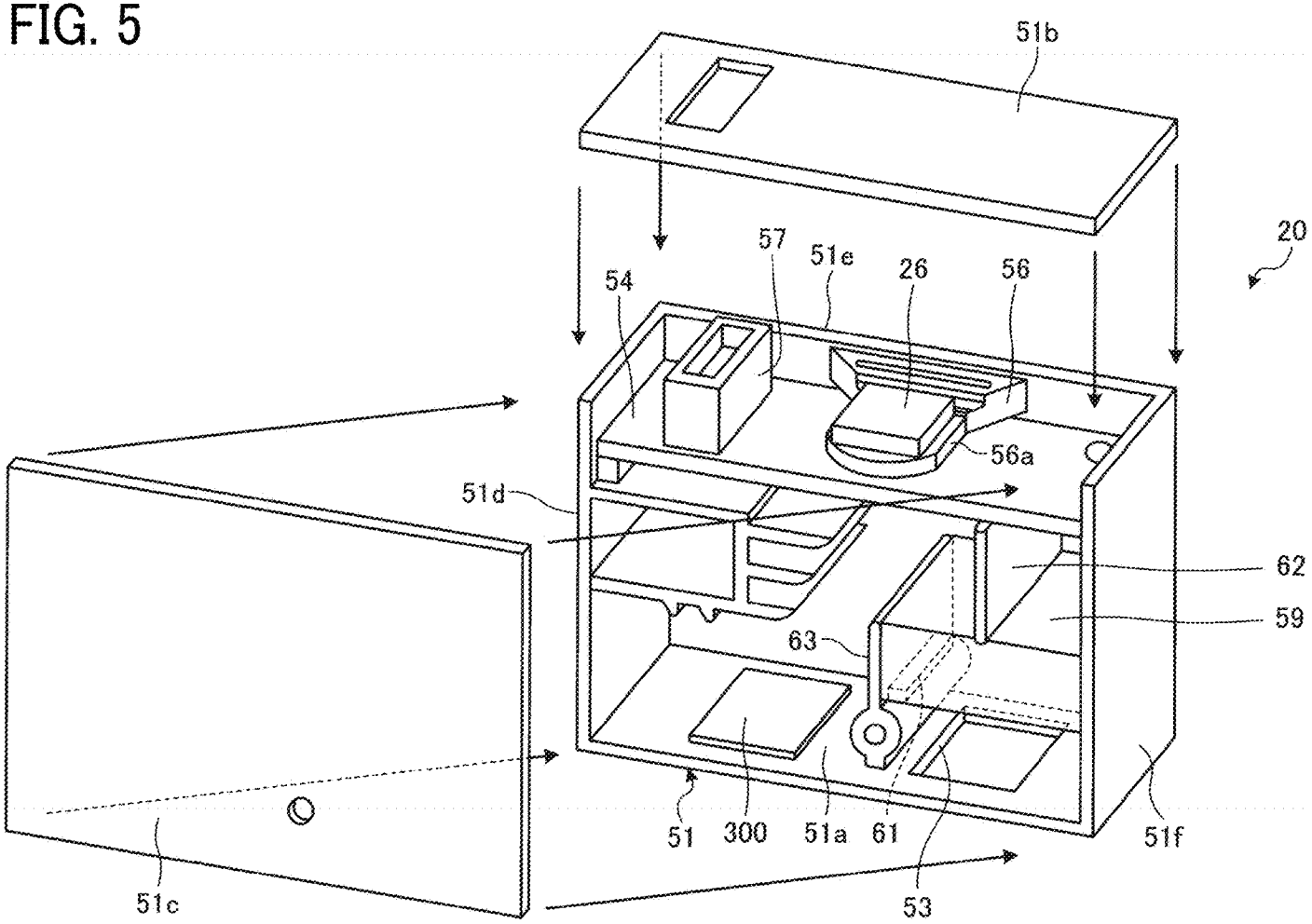
FIG. 5 is an exploded perspective view of the imaging unit.
Figure 6:
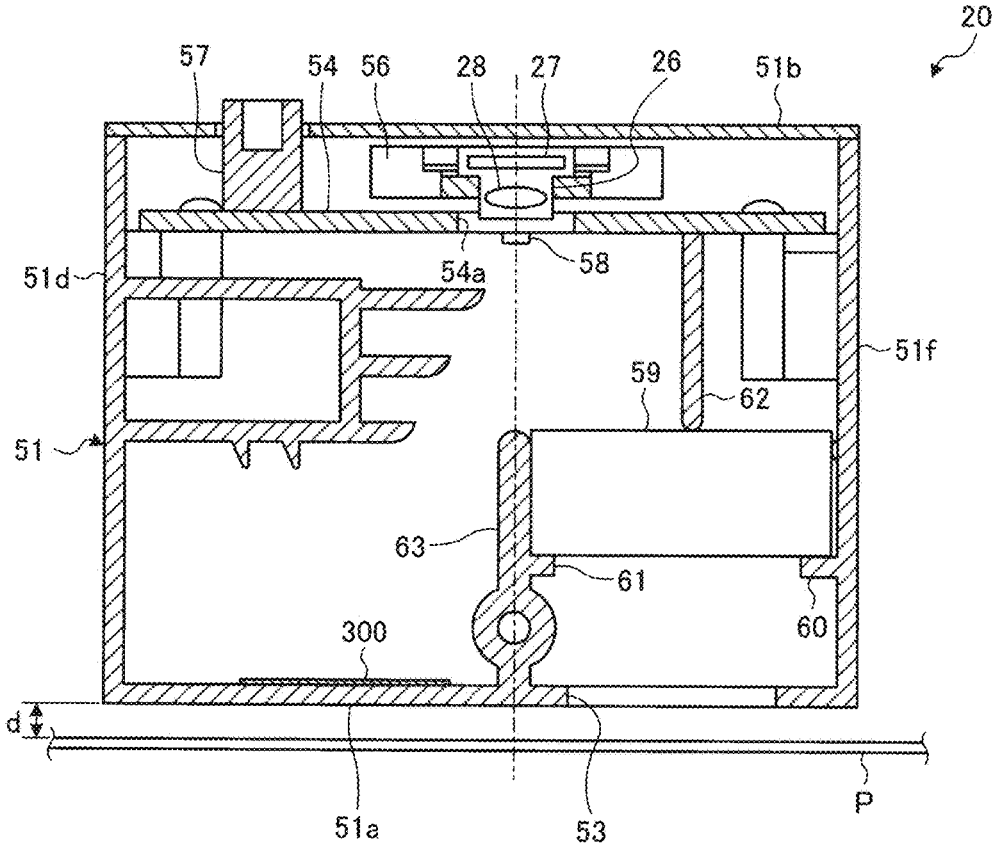
FIG. 6 is a vertical cross-sectional view of the imaging unit, viewed in a direction indicated by arrow X1 in FIG. 4.
Figure 7:
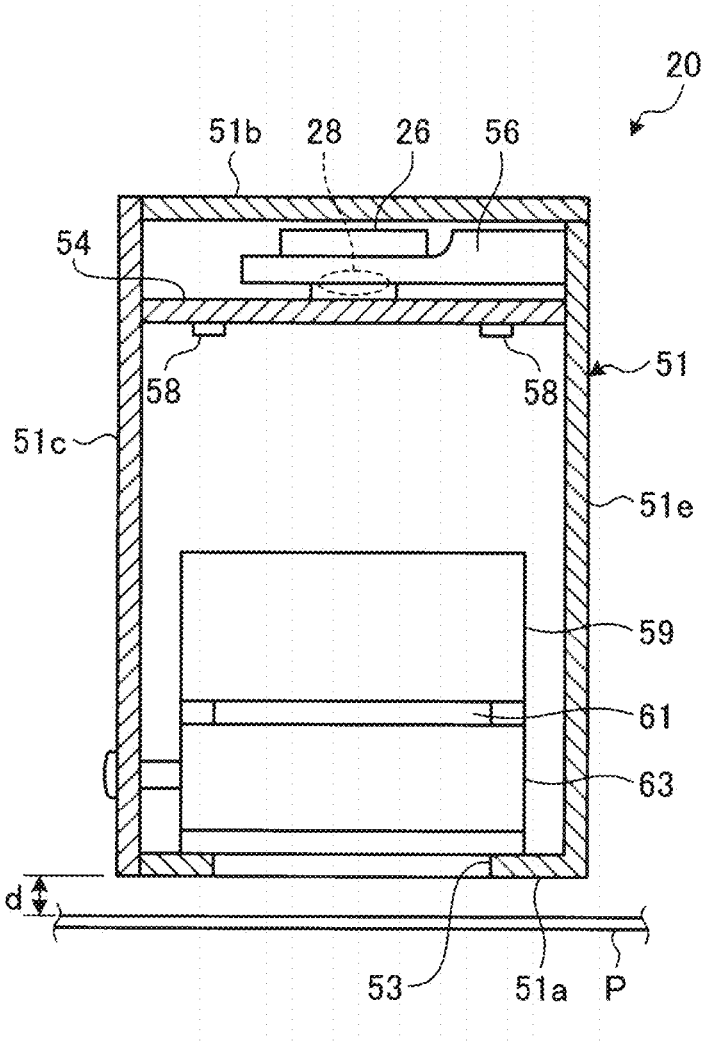
FIG. 7 is a vertical cross-sectional view of the imaging unit, viewed in a direction indicated by arrow X2 in FIG. 4.
Figure 8:
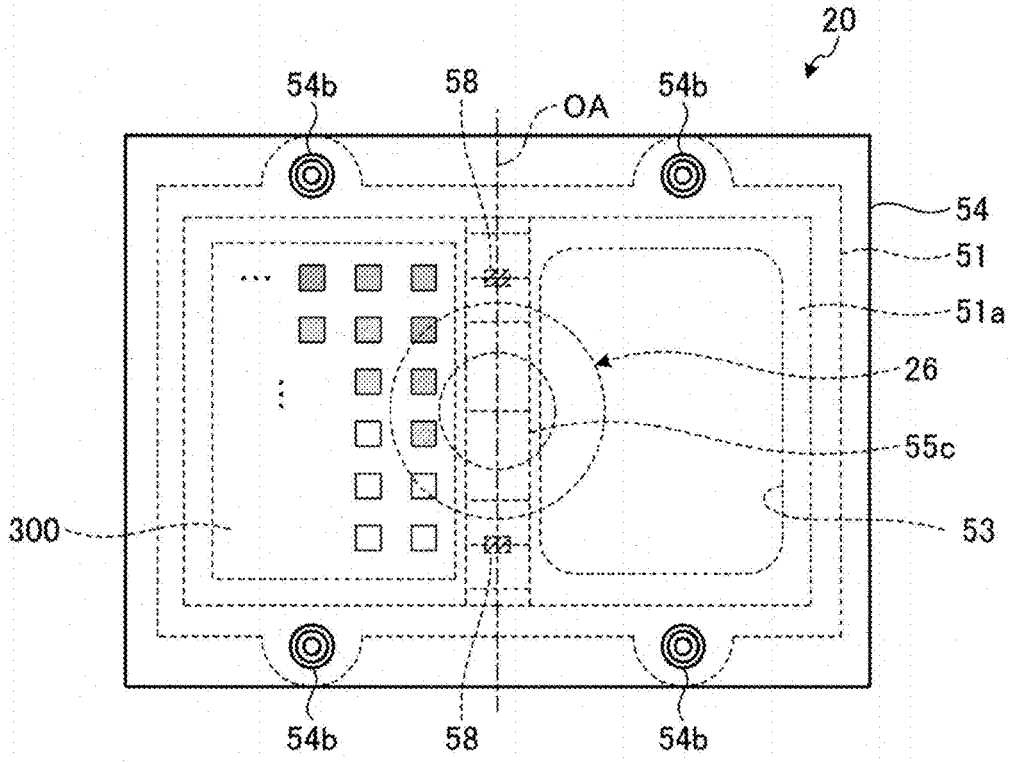
FIG. 8 is a plan view of the imaging unit.

An example in which the imaging unit 20 includes a reference chart will be described first. FIG. 4 is a perspective view of the appearance of the imaging unit. FIG. 5 is an exploded perspective view of the imaging unit. FIG. 6 is a vertical cross-sectional view of the imaging unit, as viewed in the direction indicated by arrow X1 in FIG. 4. FIG. 7 is a vertical cross-sectional view of the imaging unit, viewed in the direction indicated by arrow X2 in FIG. 4. FIG. 8 is a plan view of the imaging unit.

The imaging unit 20 includes a housing 51, for example, formed into a rectangular box. The housing 51 includes, for example, a bottom board 51*a*, a top board 51*b*, and sidewalls 51*c*, 51*d*, 51*e*, and 51*f*. The bottom board 51*a* and top board 51*b* face each other and at a predetermined interval from each other. The sidewalls 51*c*, 51*d*, 51*e*, and 51*f* couple the bottom board 51*a* to the top board 51*b*. The bottom board 51*a* and the sidewalls 51*d*, 51*e*, and 51*f* of the housing 51 are formed as a single piece by, for example, molding. The top board 51*b* and the sidewall 51*c* are detachably attached thereto. FIG. 5 illustrates the state in which the top board 51*b* and the sidewall 51*c* are detached.

For example, the imaging unit 20 is disposed on a conveyance passage in a state in which a portion of the housing 51 is supported by a predetermined support. The recording medium P on which the test pattern TP is formed is conveyed on the conveyance passage. Meanwhile, the imaging unit 20 is supported by the predetermined support so that the bottom board 51*a* of the housing 51 faces the conveyed recording medium P approximately in parallel with a gap d secured therebetween, as illustrated in FIGS. 6 and 7.

The bottom board 51*a* of the housing 51 facing the recording medium P on which the test pattern TP is formed includes an opening 53 that enables the imaging unit 20 to capture an image of the test pattern TP outside the housing 51 from the inside of the housing 51.

In addition, the housing 51 includes a reference chart 300 on an inner face of the bottom board 51*a*. The reference chart 300 is disposed next to the opening 53 via the supporting member 63. A sensor unit 26, which is described later, captures an image of the reference chart 300 together with an image of the test pattern TP for colorimetry of the test pattern TP and obtains the RGB (red green blue) values. The reference chart 300 will be described in detail later.

Meanwhile, a circuit board 54 is disposed near the top board 51*b* in the housing 51. As illustrated in FIG. 8, the housing 51 is secured to the circuit board 54 by a securing member 54*b*, and the housing 51 is shaped like a rectangular box that is open on the side of the circuit board 54. Note that the shape of the housing 51 is not limited to a rectangular box but may be a cylindrical or elliptical box including the bottom board 51*a* having the opening 53.

The housing 51 further includes the sensor unit 26 disposed between the top board 51*b* and the circuit board 54 and configured to capture an image. The sensor unit 26 includes a two-dimensional sensor 27 and an imaging lens 28 as illustrated in FIG. 6. The two-dimensional sensor 27 is, for example, a Charge Coupled Device (CCD) sensor or a Complementary Metal Oxide Semiconductor (CMOS) sensor. The imaging lens 28 forms an optical image in a capture range of the sensor unit 26 on a light-receiving face (imaging region) of the two-dimensional sensor 27. The two-dimensional sensor 27 is a light-receiving element array including two-dimensionally arranged arrays of light-receiving elements to receive the light reflected from the object to be captured (i.e., a captured object).

The sensor unit 26 is held, for example, by a sensor holder 56 integrally formed with the sidewall 51*e* of the housing 51. The sensor holder 56 includes a ring 56*a* at a position facing the through hole 54*a* on the circuit board 54. The ring 56*a* includes a through hole having a size corresponding to the external shape of a protruding portion of the sensor unit 26 including the imaging lens 28. In the sensor unit 26, as the protruding portion including the imaging lens 28 is inserted into the ring 56*a* of the sensor holder 56, the sensor holder 56 holds the imaging lens 28 so that the imaging lens 28 faces the bottom board 51*a* of the housing 51 through the through hole 54*a of the circuit board* 54.

At that time, as the sensor unit 26 is positioned and held by the sensor holder 56, an optical axis illustrated as an alternate long and short dash line in FIG. 6 is approximately perpendicular to the bottom board Ma of the housing 51, and the opening 53 and the reference chart 300 are included in the image capture range. With this structure, with a portion of the imaging region of the two-dimensional sensor 27, the sensor unit 26 captures an image of the test pattern TP outside the housing 51, through the opening 53. In addition, with another portion of the imaging region of the two-dimensional sensor 27, the sensor unit 26 can capture an image of the reference chart 300 in the housing 51.

Note that the sensor unit 26 is electrically coupled to the circuit board 54 mounting various electronic components, for example, via a flexible cable. The circuit board 54 further includes an external coupling connector 57 including a coupling cable to couple the imaging unit 20 to a main control board of the image forming apparatus 100.

The imaging unit 20 includes a pair of light sources 58 disposed on the circuit board 54, on a central line OA passing through the center of the sensor unit 26 in the sub-scanning direction. The light sources 58 are equally away from the center of the sensor unit 26 in the sub-scanning direction. The light sources 58 approximately evenly illuminate the range captured by the sensor unit 26. The light source 58 is, for example, a light emitting diode (LED) that effectively saves space and power.

In the present embodiment, the pair of LEDs is used as the light sources 58, and the LEDs are equally arranged with respect to the center of the imaging lens 28 in a direction perpendicular to a direction in which the opening 53 and the reference chart 300 are arranged as illustrated in FIGS. 7 and 8.

The two LEDs used as the light sources 58 are mounted, for example, on a face of the circuit board 54 facing the bottom board 51*a*. However, the light source 58 may be disposed at any position at which the diffusion light can approximately evenly illuminate the image capture range of the sensor unit 26. Thus, the light source 58 is not necessarily mounted on the circuit board 54 directly. In addition, placing the two LEDs symmetrically with respect to the two-dimensional sensor 27 enables the imaging unit 20 to capture an image capture face under an illumination condition same as an illumination condition under which the reference chart 300 is captured. In addition, the type of the light source 58 is not limited to the LED although the LED is used as the light source 58 in the present embodiment. For example, organic electro luminescence (EL) may be used as the light source 58. Using the organic EL as the light source 58 can provide illumination light having spectral distribution similar to the spectral distribution of sunlight. This can improve the colorimetric accuracy.

As illustrated in FIG. 8, the sensor unit 26 further includes a light absorber 55*c* immediately below the light source 58 and the two-dimensional sensor 27. The light absorber 55*c* absorbs the light from the light source 58 or reflects the light in a direction in which the two-dimensional sensor 27 is not disposed. The light absorber 55*c* has an acute shape to reflect the incident light from the light source 58 to the inner face of the light absorber 55*c* and not to reflect the light in a direction in which the incident light enters.

Inside the housing 51, a light path length changer 59 is disposed on a light path between the sensor unit 26 and the test pattern TP outside the housing 51 to be captured by the sensor unit 26 through the opening 53. The light path length changer 59 is an optical element having a refractive index n that has sufficient transmittance enabling the light of the light source 58 to pass through. The light path length changer 59 is to bring the imaging face where the test pattern TP outside the housing 51 is optically imaged close to the imaging face where the reference chart 300 inside the housing 51 is optically imaged. In other words, in the imaging unit 20, placing the light path length changer 59 on a light path between the sensor unit 26 and the captured object outside the housing 51 changes the light path length. With this structure of the imaging unit 20, both of the imaging face where the test pattern TP outside the housing 51 is optically imaged and the imaging face where the reference chart 300 inside the housing 51 is optically imaged are adjusted for the light receiving surface of the two-dimensional sensor 27 of the sensor unit 26. Thus, the sensor unit 26 can capture an image in which the test pattern TP outside the housing 51 and the reference chart 300 inside the housing 51 are in focus.

For example, a pair of ribs 60 and 61 supports both edges of the face of the light path length changer 59 facing the bottom board 51*a* as illustrated in FIG. 6. In addition, placing a pressing member 62 between the face of the light path length changer 59 facing the top board 51*b* and the circuit board 54 prevents the light path length changer 59 from moving in the housing 51. The light path length changer 59 is disposed at a position where the light path length changer 59 seals the opening 53 on the bottom board 51*a* of the housing 51. Thus, the light path length changer 59 also has a function of preventing impurities such as an ink mist or dust entering the housing 51 from the outside of the housing 51 through the opening 53 from adhering, for example, to the sensor unit 26, the light sources 58, and the reference chart 300.

Note that the mechanical configuration of the imaging unit 20 described above is merely an example, and the mechanical configuration is not limited to the example. The imaging unit 20 can has any structure as long as the sensor unit 26 in the housing 51 captures an image of the test pattern TP outside the housing 51 through the opening 53 while the light sources 58 in the housing 51 are on (emit light). The imaging unit 20 may be variously modified from the above-described structure.

For example, the imaging unit 20 described above includes the reference chart 300 on the inner face of the bottom board 51*a* of the housing 51. Alternatively, the imaging unit 20 may have a structure in which another opening different from the opening 53 is disposed at the position on the bottom board 51*a* of the housing 51 where the reference chart 300 is disposed so that the reference chart 300 is attached to the position where the opening is disposed from the outside the housing 51. In this example, the sensor unit 26 captures an image of the test pattern TP on the recording medium P through the opening 53 and simultaneously captures an image of the reference chart 300 attached to the bottom board 51*a* of the housing 51 from the outside through the opening different from the opening 53. This example has an advantage to make it easy to exchange the reference chart 300 at the occurrence of a problem such as a smudging of the reference chart 300.

Figure 9:
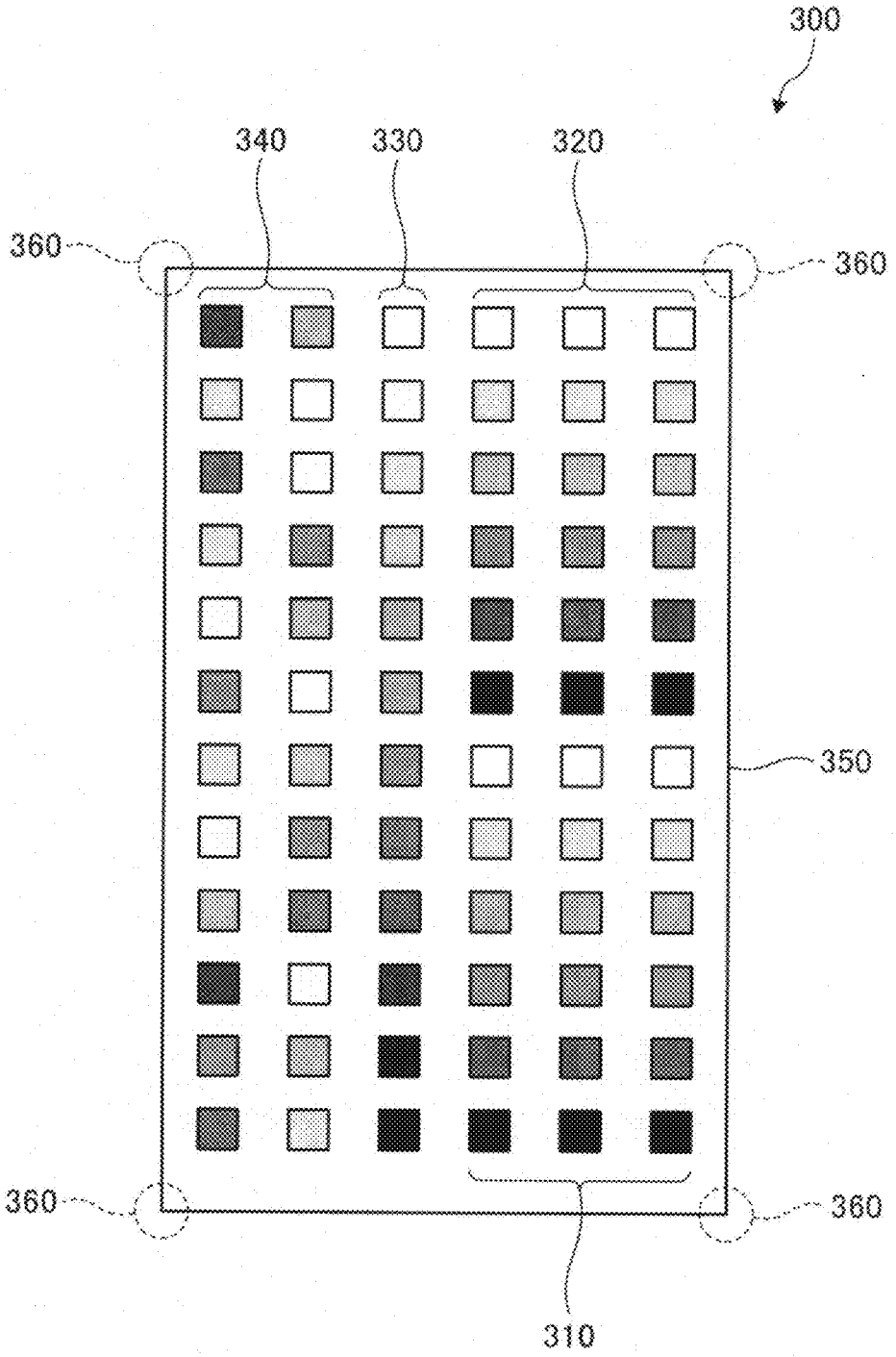
FIG. 9 is a diagram of an example of a reference chart according to Embodiment 1.

Next, an example of the reference chart 300 disposed in the housing 51 of the imaging unit 20 will be described referring to FIG. 9. FIG. 9 illustrates an example of the reference chart.

The reference chart 300 illustrated in FIG. 9 includes a plurality of colorimetric patch lines 310 to 340 in which colorimetric patches for colorimetry are lined, a distance measurement line 350, and chart position determination marks 360.

The colorimetric patch line 310 includes colorimetric patches for primary colors, yellow (Y), magenta (M), cyan (C), and black (K), arranged in gradation order. The colorimetric patch line 320 includes colorimetric patches for secondary colors, red (R), green (G), and blue (B), arranged in gradation order. The colorimetric patch line 330 (an achromatic gradation pattern) includes colorimetric patches for gray scale arranged in gradation order. The colorimetric patch line 340 includes colorimetric patches for tertiary colors arranged in gradation order.

The distance measurement line 350 is a rectangular frame surrounding the plurality of colorimetric patch lines 310 to 340. The chart position determination marks 360 are disposed on the four corners of the distance measurement line 350 and function as markers to determine the position of each of the colorimetric patches. In the image of the reference chart 300 captured with the sensor unit 26, the distance measurement line 350 and the chart position determination marks 360 on the four corners thereof are identified to determine the position of the reference chart 300 and the position of each of the colorimetric patches.

Each of the colorimetric patches included in the colorimetric patch lines 310 to 340 for colorimetry is used as a reference to determine the color tone reflecting the condition under which the sensor unit 26 captures the image. Note that the structures of the colorimetric patch lines 310 to 340 for colorimetry in the reference chart 300 are not limited to the example illustrated in FIG. 9, and an arbitrary colorimetric patch line may be used. For example, a colorimetric patch that can determine colors in a color range as wide as possible may be used. Alternatively, the colorimetric patch line 310 for the primary colors YMCK or the colorimetric patch line 330 for gray scale may include a patch having a colorimetric value of the coloring material used in the image forming apparatus 100. Alternatively, the colorimetric patch line 320 for the secondary colors RGB may include a patch having a colorimetric value to be reproduced with the coloring material used in the image forming apparatus 100. Furthermore, a reference color patch having a colorimetric value specified in Japan Color may be used.

Note that, although the reference chart 300 according to the present embodiment uses the colorimetric patch lines 310 to 340 including patches (color patches) of a typical shape, the reference chart 300 does not necessarily include such colorimetric patch lines 310 to 340. The reference chart 300 can have any configuration in which a plurality of colors for colorimetry is arranged so that the positions thereof can be identified.

As described above, the reference chart 300 is disposed on the inner face of the bottom board 51*a* of the housing 51 and on a side of the opening 53. Accordingly, the sensor unit 26 can simultaneously capture an image of the reference chart 300 and an image of the test pattern TP outside the housing 51. Note that the simultaneous image capture in this example means that acquiring image data of a frame including the test pattern TP outside the housing 51 and the reference chart 300. In other words, even if the data of each pixel is obtained at a different time, as long as image data of a frame including the test pattern TP outside the housing 51 and the reference chart 300 is acquired, the test pattern TP outside the housing 51 and the reference chart 300 are captured at the same time as one image.

[Example 2 of Imaging Unit]

Figure 10:
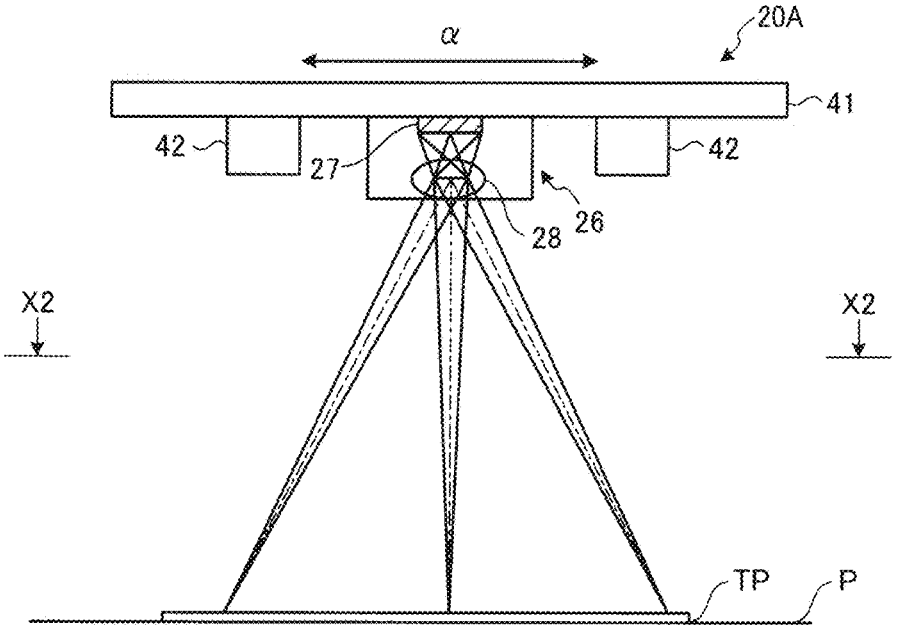
FIG. 10 is a vertical cross-sectional view of an imaging unit according to Embodiment 1.
Figure 11:
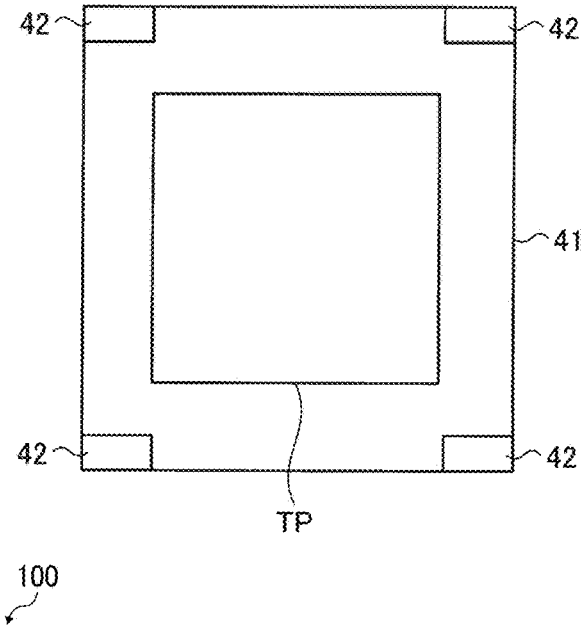
FIG. 11 is a plan view of the imaging unit of FIG. 10, viewed in the direction indicated by arrow X2.

An example of an imaging unit 20A without a reference chart will be described in detail below, referring to FIGS. 10 and 11. FIG. 10 is a vertical cross-sectional view of the imaging unit 20A. FIG. 11 is a plan view of the imaging unit 20A of FIG. 10, as viewed in the direction indicated by arrow X2.

As illustrated in FIG. 10, the imaging unit 20A includes a board 41 secured to a carriage 5, light sources 42, and a sensor unit 26. The light source 42 and the sensor unit 26 are mounted on the board 41.

For example, an LED is used as the light source 42. The test pattern TP on the recording medium P that is a captured object is irradiated with illumination light, and the light reflected (diffusely or specularly) therefrom enters the sensor unit 26. As illustrated in FIG. 11, four light sources 42 are disposed to surround the test pattern TP on the recording medium P so as to evenly irradiate the test pattern TP with the illumination light.

The sensor unit 26 includes a two-dimensional sensor 27 such as a CCD sensor or a CMOS sensor and an imaging lens 28. The sensor unit 26 causes the reflected light of the illumination light, emitted from the light source 42 to the test pattern TP, to enter the two-dimensional sensor 27 through the imaging lens 28. The two-dimensional sensor 27 converts the entering light into an analog signal by photoelectric conversion, and outputs the signal as the captured image of the test pattern TP.

[Detailed Description of Conveyor]

Figure 12:
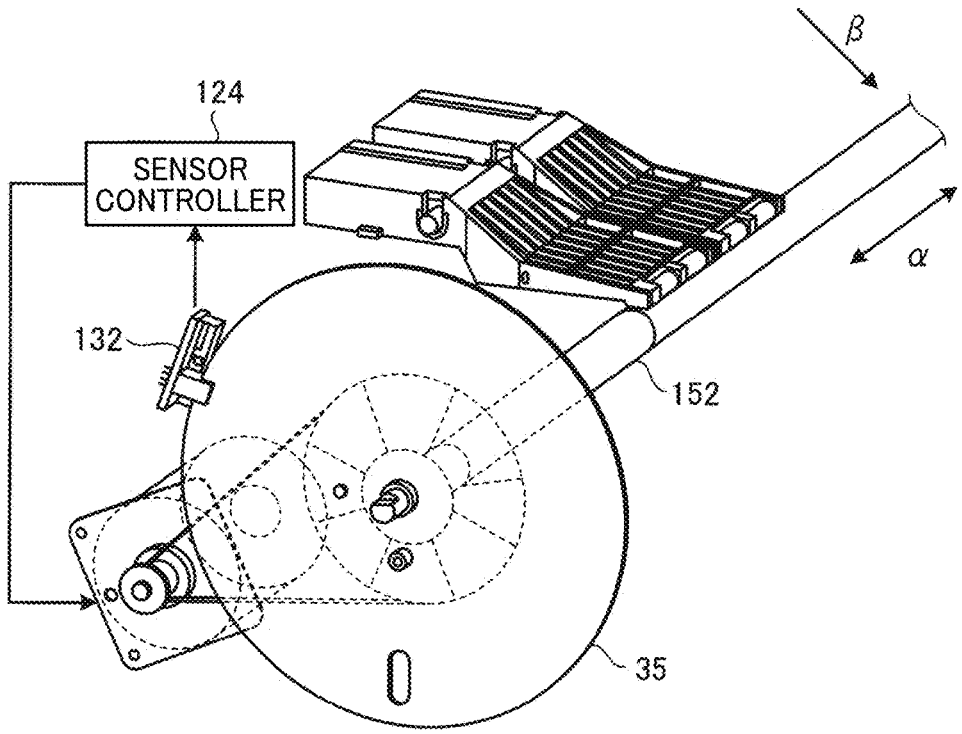
FIG. 12 is a view of an arrangement around a conveyance roller according to Embodiment 1.

A conveyor 150 to convey the recording medium P that is a conveyed object will be described. FIG. 12 is a schematic view of an arrangement around a conveyance roller. As illustrated in FIG. 12, the recording medium P is intermittently conveyed in the sub-scanning direction (indicated by arrow β in the drawings) perpendicular to the main scanning direction (indicated by arrow α in the drawings) in which the carriage 5 moves. In the conveyance, a sub-scanning encoder sensor 132 on a side plate reads an encoder 35 coaxially disposed with a conveyance roller 152.

The amount of conveyance of the recording medium P is controlled, based on the information read as described above, by a sensor controller 124 (see FIG. 13) electrically coupled to the sub-scanning encoder sensor 132. In this example, the encoder 35 is a rotary encoder including a disc having an optical grid. Thus, the angle, rotation amount, and rotation speed of the encoder can be detected.

[Hardware Configuration of Image Forming Apparatus]

Figure 13:
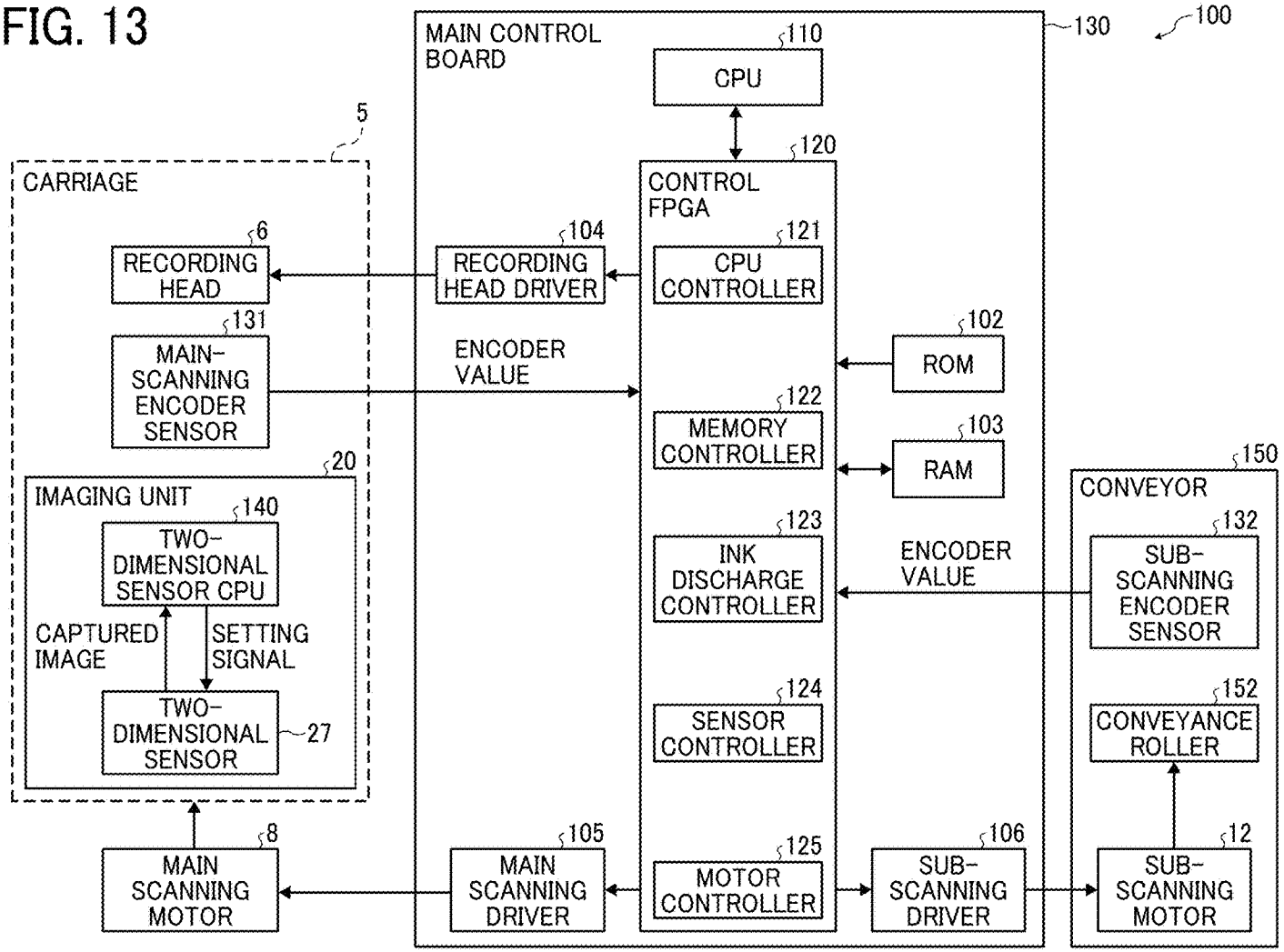
FIG. 13 is a block diagram of a hardware configuration of the image forming apparatus according to Embodiment 1.

A hardware configuration of the image forming apparatus 100 according to the present embodiment will be described referring to FIG. 13. FIG. 13 is a block diagram of the hardware configuration of the image forming apparatus according to Embodiment 1.

As illustrated in FIG. 13, the image forming apparatus 100 according to the present embodiment includes a central processing unit (CPU) 110, a read-only memory (ROM) 102, a random access memory (RAM) 103, a recording head driver 104, a main scanning driver 105, a sub-scanning driver 106, a control Field-Programmable Gate Array (FPGA) 120, a recording head 6, a main-scanning encoder sensor 131, the imaging unit 20, a main scanning motor 8, and the conveyor 150.

The CPU 110, the ROM 102, the RAM 103, the recording head driver 104, the main scanning driver 105, the sub-scanning driver 106, and the control FPGA 120 are mounted on a main control board 130. Meanwhile, the recording head 6, the main-scanning encoder sensor 131, and the imaging unit 20 are mounted on the carriage 5 as described above. In addition, the sub-scanning encoder sensor 132, the conveyance roller 152, and the sub-scanning motor 12 are mounted on the conveyor 150.

The CPU 110 controls the entire image forming apparatus 100. For example, the CPU 110 uses the RAM 103 as a work area to execute various control programs stored on the ROM 102 in order to output a control command to control each operation in the image forming apparatus 100. In particular, the image forming apparatus 100 according to the present embodiment uses the CPU 110 to implement, for example, a function to form the test pattern TP, a function as a distance measurement device, and a function to adjust a parameter relating to the amount of conveyance of the recording medium P based on the distance. Those functions will be described in detail later.

The recording head driver 104, the main scanning driver 105, and the sub-scanning driver 106 drive the recording head 6, the main scanning motor 8, and the sub-scanning motor 12, respectively.

The control FPGA 120 cooperates with the CPU 110 to control various types of operation in the image forming apparatus 100. The control FPGA 120 includes, for example, a CPU controller 121, a memory controller 122, an ink discharge controller 123, a sensor controller 124, and a motor controller 125 as functional components.

The CPU controller 121 communicates with the CPU 110 to transmit various types of information that the control FPGA 120 obtains to the CPU 110 and input a control command output from the CPU 110.

The memory controller 122 performs memory control to enable the CPU 110 to access the ROM 102 or the RAM 103.

The ink discharge controller 123 controls the operation of the recording head driver 104 in response to the control command from the CPU 110 in order to control the discharge timing at which ink is discharged from the recording head 6 driven by the recording head driver 104.

The sensor controller 124 processes a sensor signal such as encoder values output from the main-scanning encoder sensor 131 and the sub-scanning encoder sensor 132. For example, the sensor controller 124 performs a process for calculating, for example, the position, travel speed, and travel direction of the carriage 5 based on the encoder value output from the main-scanning encoder sensor 131. For example, the sensor controller 124 similarly performs a process for calculating the rotation speed or rotation direction of the conveyance roller 152 conveying the recording medium P based on the encoder value output from the sub-scanning encoder sensor 132.

The motor controller 125 controls the operation of the main scanning driver 105 in response to the control command from the CPU 110 to control the main scanning motor 8 driven by the main scanning driver 105 in order to control the movement of the carriage 5 in the main scanning direction. The motor controller 125 similarly controls the operation of the sub-scanning driver 106 in response to the control command from the CPU 110 to control the sub-scanning motor 12 driven by the sub-scanning driver 106 in order to control the movement (conveyance) of the recording medium P with the conveyance roller 152 in the sub-scanning direction.

Note that each component described above is an exemplary control function implemented by the control FPGA 120, and other control functions than the functions described above may also be implemented by the control FPGA 120. Alternatively, all or some of the control functions described above may be implemented by the program executed by the CPU 110 or another general-purpose CPU. Alternatively, some of the control functions described above may be implemented by dedicated hardware such as another FPGA different from the control FPGA 120 or an application specific integrated circuit (ASIC).

The recording head 6 includes a plurality of nozzles to discharge ink to form an image (see FIG. 3). The CPU 110 and the control FPGA 120 control the operation of the recording head driver 104. The recording head driver 104 drives the recording head 6 so that the recording head 6 discharges ink onto the recording medium P on the platen 16 to form an image.

The main-scanning encoder sensor 131 detects the mark of the encoder sheet 14 to obtain an encoder value, and outputs the obtained encoder value to the control FPGA 120. The sensor controller 124 of the control FPGA 120 uses the output encoder value to calculate the position, travel speed, and travel direction of the carriage 5. The position, travel speed, and travel direction of the carriage 5, which are calculated by the sensor controller 124 according to the encoder value, are transmitted to the CPU 110. The CPU 110 generates a control command to control the main scanning motor 8 according to the calculated position, travel speed, and travel direction of the carriage 5, and outputs the control command to the motor controller 125.

The imaging unit 20 captures an image of the test pattern TP on the recording medium P and performs various processing of the captured image, controlled by the CPU 110. The imaging unit 20 includes a two-dimensional sensor CPU 140 and the two-dimensional sensor 27.

The two-dimensional sensor 27 is, for example, a CCD sensor or a CMOS sensor as described above. The two-dimensional sensor 27 captures an image of the test pattern TP under predetermined operation conditions according to various setting signals transmitted from the two-dimensional sensor CPU 140. Then, the two-dimensional sensor 27 transmits the captured image to the two-dimensional sensor CPU 140.

The two-dimensional sensor CPU 140 controls the two-dimensional sensor 27 and processes the image captured by the two-dimensional sensor 27. In specific, the two-dimensional sensor CPU 140 transmits various setting signals to the imaging unit 20 in order to set various operation condition under which the two-dimensional sensor 27 operates. In addition, the two-dimensional sensor CPU 140 implements detection of the mark of the test pattern TP in the captured image of the test pattern TP, and calculation of the ratio between the distance in the captured image and the actual distance. Those functions will be described in detail later.

The imaging unit 20 according to the present embodiment is mounted on the carriage 5 (see FIG. 3), and the carriage 5 preferably stops while the imaging unit 20 captures an image of the test pattern TP. Although, in the present embodiment, the imaging unit 20 is mounted together with the recording head 6 on the carriage 5, the imaging unit 20 is not necessarily mounted on the carriage 5 and may be disposed separately from the recording head 6 as long as the imaging unit 20 can capture an image of the test pattern TP.

The imaging unit 20 further includes a RAM and a ROM so that, for example, the two-dimensional sensor CPU 140 uses the RAM as a work area to execute various control programs stored on the ROM in order to output a control command to control each operation of the imaging unit 20. In addition, the two-dimensional sensor CPU 140 has functions of converting the analog signal obtained in the photoelectric conversion by the two-dimensional sensor 27 into the digital image data in AD conversion and processing the digital image data in various image processing processes such as shading correction, white-balance correction, y correction, and image data format conversion. Some of or the entire image processing processes for the captured image may be performed outside the imaging unit 20.

The sub-scanning encoder sensor 132 outputs the encoder value read from the encoder 35 to the control FPGA 120. The sensor controller 124 of the control FPGA 120 uses the encoder value to calculate the rotation speed and rotation direction of the conveyance roller 152 conveying the recording medium P. The rotation speed and rotation direction of the conveyance roller 152 calculated according to the encoder value by the sensor controller 124 are transmitted to the CPU 110. The CPU 110 generates a control command to control the sub-scanning motor 12 according to the calculated rotation speed and rotation direction of the conveyance roller 152 and outputs the control command to the motor controller 125.

As the sub-scanning motor 12 rotates at the rotation speed in the rotation direction according to the control command received from the motor controller 125, the conveyance roller 152 convey the recording medium P by a predetermined amount.

In the image forming apparatus 100 according to the present embodiment, the recording head driver 104, the main scanning driver 105, the sub-scanning driver 106, the recording head 6, the main scanning motor 8, and the sub-scanning motor 12 together function as an image forming device to form an image on the recording medium P. The recording head driver 104, the main scanning driver 105, and the sub-scanning driver 106 are controlled by the CPU 110 and the control FPGA 120. The recording head 6, the main scanning motor 8, and the sub-scanning motor 12 are driven by those drivers.

In FIG. 13, the two-dimensional sensor CPU 140 and the imaging unit 20 are mounted on the carriage 5. However, the two-dimensional sensor CPU 140 and the imaging unit 20 may be disposed at any positions where the two-dimensional sensor CPU 140 and the imaging unit 20 can appropriately capture an image of the test pattern TP on the recording medium P. Thus, the two-dimensional sensor CPU 140 and the imaging unit 20 are not necessarily mounted on the carriage 5.

[Functional Configuration of Image Forming Apparatus]

Figure 14:
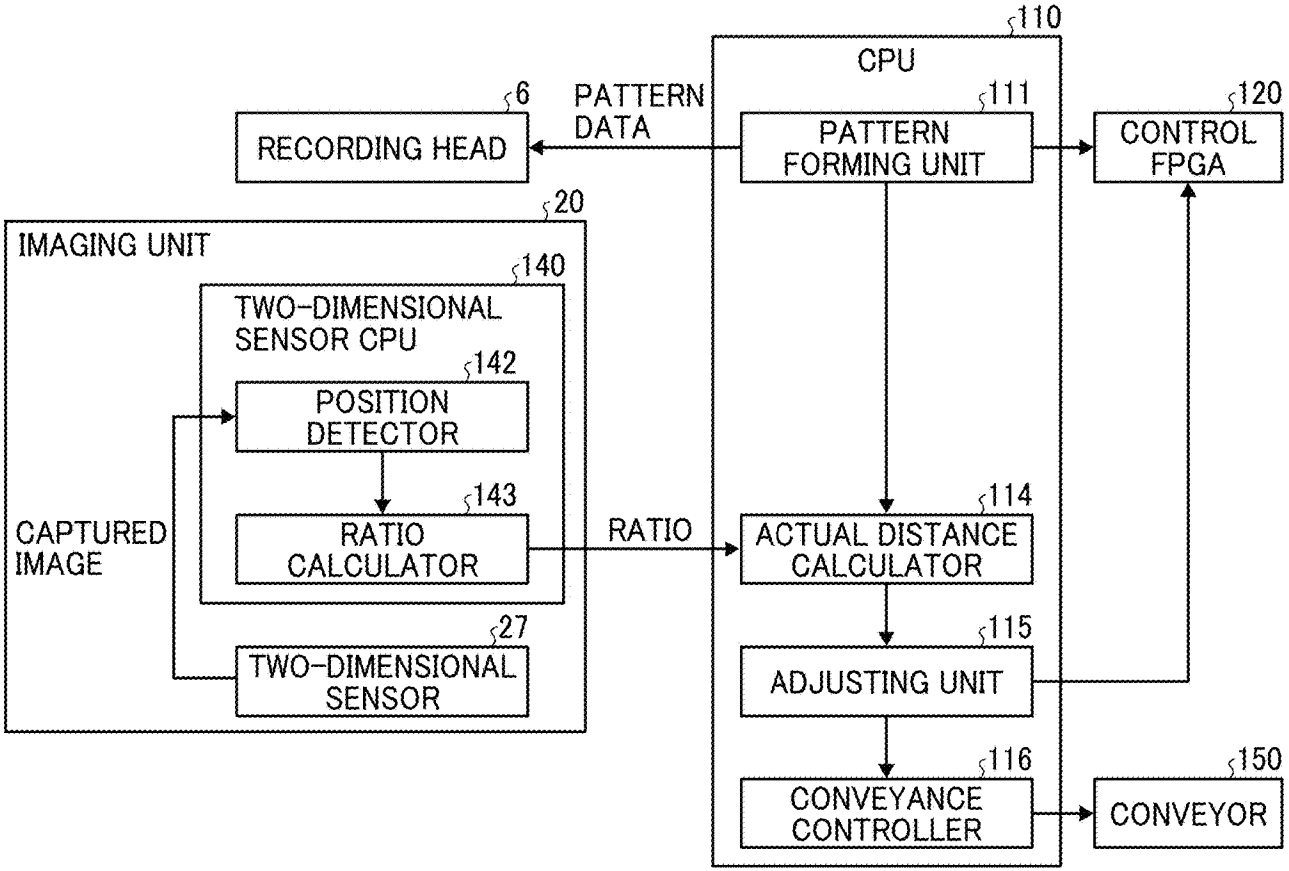
FIG. 14 is a block diagram of a functional configuration of the image forming apparatus according to Embodiment 1.

Characteristic functions implemented by the CPU 110 and two-dimensional sensor CPU 140 of the image forming apparatus 100 will be described, referring to FIG. 14. FIG. 14 is a block diagram of a functional configuration of the image forming apparatus according to Embodiment 1.

For example, the CPU 110 uses the RAM 103 as a work area to execute a control program stored on the ROM 102 in order to implement, for example, the functions of the pattern forming unit 111, the actual distance calculator 114, the adjusting unit 115, and the conveyance controller 116. For example, the two-dimensional sensor CPU 140 of the imaging unit 20 similarly uses the RAM as a work area to execute a control program stored on the ROM in order to implement, for example, the functions of the position detector 142 and the ratio calculator 143.

The conveyance controller 116 of the CPU 110 controls the conveyance roller 152 of the conveyor 150 to convey the recording medium P. For example, the conveyance controller 116 determines the rotation speed and rotation direction of the conveyance roller 152 based on the encoder value output from the sub-scanning encoder sensor 132. Then, the conveyance controller 116 transmits a control command indicating the determined rotation speed and rotation direction via the control FPGA 120 to the sub-scanning motor 12, thereby enabling the sub-scanning motor 12 to control the conveyance roller 152 to convey the recording medium P according to the transmitted control command.

The pattern forming unit 111 of the CPU 110 reads the pattern data preliminarily stored, for example, on the ROM 102 and causes the image forming device described above to form, according to the pattern data, the test pattern TP on the recording medium P. The imaging unit 20 captures an image of the test pattern TP on the recording medium P formed by the pattern forming unit 111. Note that an example in which a recording head 6A is used to form the test pattern TP will be described in the present embodiment.

The test pattern TP according to the present embodiment is a set of marks including at least a pair of first marks M1*a* and M1*b* and a second mark M2. The test pattern TP will be described in detail later (see FIGS. 16A and 16B). The pattern forming unit 111 forms the pair of first marks M1*a* and M1*b*, using the recording head 6A, while the carriage 5 moves in a forward or backward direction. The pattern forming unit 111 forms the second mark M2 using the recording head 6A while the carriage 5 moves in the direction opposite to the direction in which the carriage 5 moves to form the pair of first marks M1*a* and M1*b*.

In the present embodiment, a description is given of an example in which the pattern forming unit 111 forms the pair of first marks M1*a* and M1*b* on the recording medium P while the recording head 6A moves in the forward direction (first direction) and forms the second mark M2 on the recording medium P while the recording head 6A moves in the backward direction (second direction). Note that the marks may be formed in either order, and thus the pattern forming unit 111 may form the second mark M2 while the recording head 6A moves in the forward direction and form the pair of first marks M1*a* and M1*b* while the recording head 6A moves in the backward direction.

Figure 15:
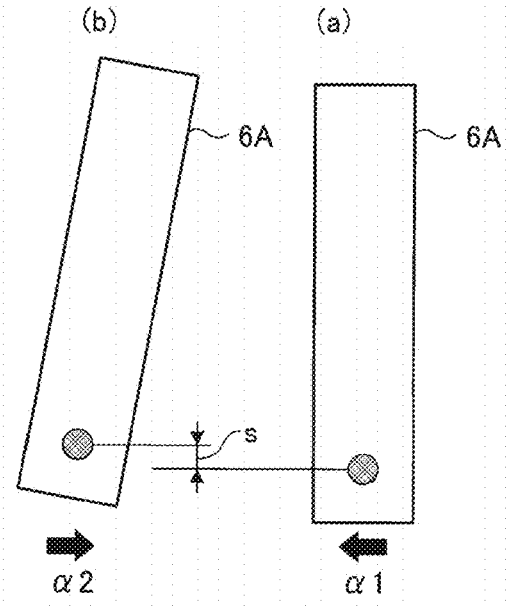
FIG. 15 is a diagram illustrating inclination of a recording head.

In the description below, in forming the test pattern TP on the recording medium P, the inclination of the recording head 6A is different between the forward movement and the backward movement. In FIGS. 15, (*a*) and (*b*) illustrate the inclinations of the recording head. FIG. 15(*a*) illustrates the recording head 6A moving in the forward direction and FIG. 15(*b*) illustrates the recording head 6A moving in the backward direction.

In FIGS. 15, (*a*) and (*b*) illustrate a case in which, due to the stiffness of the carriage 5, the looseness between a guide and the carriage 5, or the like, the inclination of the recording head 6A differs depending on the scanning direction of the carriage 5. In such a case, when the same nozzle is used to form an image at the same position in the backward movement (indicated by arrow α1 in the drawing) of the carriage 5 and the forward movement (indicated by arrow α2 in the drawing) of the carriage 5, the landing position of ink deviates in the sub-scanning direction by a distance s (hereinafter also "deviation amount s"). As a result, when an image is formed in the forward movement (the direction indicated by arrow α1), and then the recording medium P is conveyed and the image is formed in the backward movement (the direction indicated by arrow α2), the image is not formed at a desired position. This may cause a void or an overlay of discharged ink in the image.

In light of the foregoing, the image forming apparatus 100 according to the present embodiment moves the recording head 6A in both the forward direction and the backward direction to form the test pattern TP and captures an image of the test pattern TP. Then, the image forming apparatus 100 calculates the amount of deviation of the landing position of ink in the captured image. This enables the image forming apparatus 100 to adjust the amount of conveyance in each of the scanning directions.

Figure 16A:
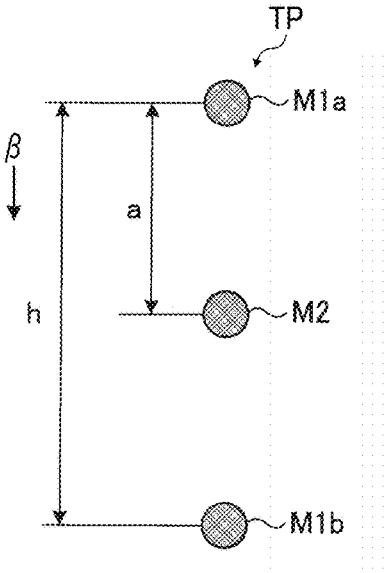
FIGS. 16A and 16B are diagrams of a test pattern formed on a recording medium, according to Embodiment 1.
Figure 16B:
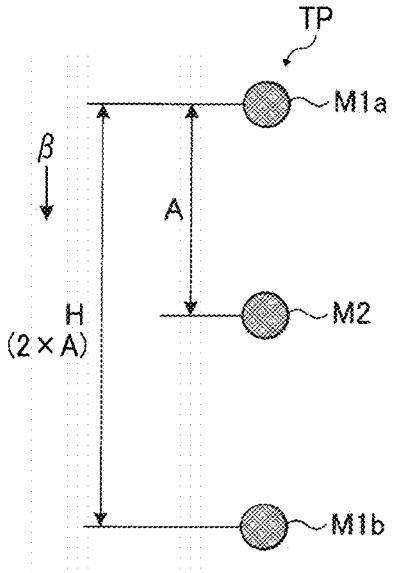

Here, the test pattern TP will be described. FIGS. 16A and 16B each illustrate an exemplary test pattern formed on a recording medium. FIG. 16A illustrates the relative positions of the marks of the captured image. FIG. 16B illustrates theoretical relative positions of the marks. The test pattern TP illustrated in FIGS. 16A and 16B is a set of marks including a pair of first marks M1*a* and M1*b* formed by first and second nozzles 6A1 and 6A2 and a second mark M2 formed by a third nozzle 6A3 (see FIG. 3). In addition, the pair of first marks M1*a* and M1*b* and the second mark M2 are formed as dots lined in the sub-scanning direction in which the recording medium P is conveyed (indicated by arrow β in the drawing).

As illustrated in FIG. 16B, in the test pattern TP according to the present embodiment, the second mark M2 in theory is disposed at a midpoint of the first marks M1*a* and M1*b*. In other words, a distance H between the first marks M1*a* and M1*b* in the theoretical test pattern TP is twice as long as a distance A between the first mark M1*a* and the second mark M2. By contrast, in the captured image of the test pattern TP on the recording medium P illustrated in FIG. 16A, the first marks M1*a* and M1*b* are at a distance h from each other, and the first mark M1*a* and the second mark M2 are at a distance a from each other.

A method for forming the test pattern TP will be described next. To form the test pattern TP illustrated in FIG. 16A, for example, the pair of first marks M1*a* and M1*b* is formed on the recording medium P in the forward movement and the second mark M2 is formed in the direction opposite to the direction in which the pair of first marks M1*a* and M1*b* is formed. The pair of first marks M1*a* and M1*b* is formed with the first and second nozzles 6A1 and 6A2 (illustrated in FIG. 3) disposed at the distance H (first distance) from each other. The second mark M2 is formed with the third nozzle 6A3 positioned at the distance A (second distance) from the first nozzle 6A1 to form the first mark M1*a*.

Accordingly, when the recording head 6A inclines at the same angle in the forward movement and the backward movement, the test pattern TP includes the second mark M2 located at an ideal position that is the midpoint of the first marks M1*a* and M1*b* in the sub-scanning direction. Note that nozzle bending is not considered in this example. On the other hand, when the recording head 6A inclines at different angles between the forward movement and the backward movement, the test pattern TP includes the second mark M2 located at a position deviated in both the main scanning direction and the sub-scanning direction.

Note that, although the ideal position of the second mark M2 is the midpoint of the first marks M1*a* and M1*b* in the present embodiment, the ideal position is not necessarily the midpoint of the first marks M1*a* and M1*b*. In other words, the ideal position of the second mark M2 may be any predetermined position where the second mark M2 can be captured together with the pair of first marks M1*a* and M1*b*. The ideal position may be nearer to one of the first marks M1*a* and M1*b* or is not necessarily between the first marks M1*a* and M1*b*.

As described above, the test pattern TP may be formed in any manner in which the pair of first marks M1*a* and M1*b* is formed while the carriage 5 moves in either forward direction or backward direction and the second mark M2 is formed while the carriage 5 moves in the direction opposite to the direction in which the pair of first marks M1*a* and M1*b* is formed. The relative positions of the pair of first marks M1*a* and M1*b* and the second mark M2 may be arbitrarily set. In addition, the position and timing to form each of the pair of first marks M1*a* and M1*b* and the second mark M2 included in the test pattern TP are indicated in the pattern data described above. According to the timing mentioned here, the mark is formed in either in the forward movement of the carriage 5 or the backward movement of the carriage 5.

Referring back to FIG. 14, the position detector 142 of the two-dimensional sensor CPU 140 processes the image captured with the imaging unit 20 in a predetermined process such as a binarization process to detect each of the pair of first marks M1*a* and M1*b* and the second mark M2 from the captured image.

The ratio calculator 143 of the two-dimensional sensor CPU 140 calculates the ratio between the distance between the first marks M1*a* and M1*b* in the captured image and the amount of deviation of the second mark M2 in the captured image based on the positions of the pair of first marks M1*a* and M1*b* and the second mark M2 in the captured image.

Figure 17:
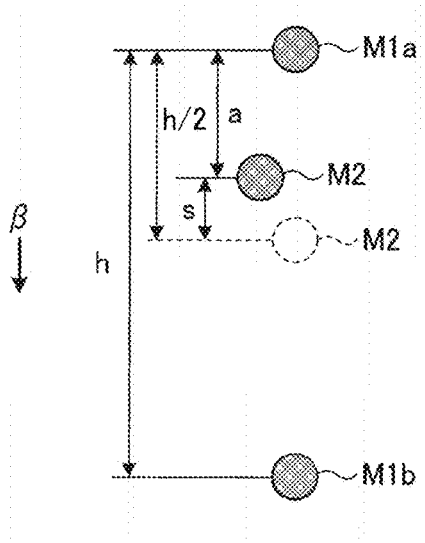
FIG. 17 is a diagram of a ratio calculation method for calculating a ratio between a distance between a pair of first marks and the amount of deviation of a second mark in a captured image, according to Embodiment 1.

A method for calculating the ratio will be described in detail, referring to FIG. 17. FIG. 17 is a diagram of the method for calculating the ratio between the distance between the first marks M1*a* and M1*b* and the amount of deviation of the second mark M2 in the captured image. As illustrated in FIG. 17, the ratio calculator 143 obtains the distance h between the first marks M1*a* and M1*b* in the captured image from the detected positions of the first marks M1*a* and M1*b*. Then, the ratio calculator 143 obtains the deviation amount s of the second mark M2 in the captured image based on the difference between the detected second mark M2 and the ideal position of the second mark M2.

In the example described here, the ideal position of the second mark M2 is the midpoint of the first marks M1*a* and M1*b*, in other words, a position away from each of the first marks M1*a* and M1*b* by half the distance between the first marks M1*a* and M1*b*. In FIG. 17, the ideal position of the second mark M2 is a position equidistance (at a distance h/2 in FIG. 17) from the first mark M1*a* and the second mark M1*b*.

Thus, the deviation amount s of the second mark M2 in the captured image is the difference between the distance h/2 between the first mark M1*a* and the ideal position of the second mark M2 and the distance a between the first mark M1*a* and the second mark M2 (e.g., s=h/2−a). Then, the deviation amount s of the second mark M2 in the captured image is divided by the distance h between the first marks M1*a* and M1*b* in the captured image, thereby calculating the ratio (s/h). The ratio calculator 143 transmits the calculated ratio to the actual distance calculator 114.

A method for calculating the ratio when the ideal position of the second mark M2 is not at the midpoint of the first marks M1*a* and M1*b* will be described. In such a case, the ideal position of the second mark M2 is preliminarily stored on the two-dimensional sensor CPU 140. When FIG. 17 is cited, for example, the two-dimensional sensor CPU 140 stores the position of the second mark M2 relative to the pair of first marks M1*a* and M1*b*. When the distance h between the first marks M1*a* and M1*b* is obtained, the distance h/2 between the first mark M1*a* and the ideal position of the second mark M2 is obtained. Then, the detected pair of first marks M1*a* and M1*b* and the second mark M2 are used to obtain the distance h between the first marks M1*a* and M1*b* and the distance a between the first mark M1*a* and the second mark M2. Thus, the ratio described above can be calculated.

Figure 18:
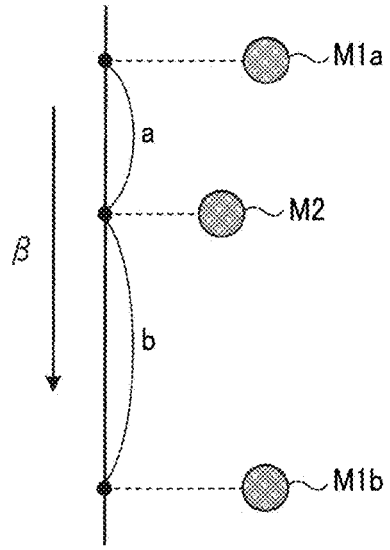
FIG. 18 is a diagram of a relative deviation between the pair of first marks and the second mark in a test pattern.

Here, a description is given of an example in which the relative positions of the pair of first marks M1*a* and M1*b* and the second mark M2 deviate in formation of the test pattern TP illustrated in FIG. 16A on the recording medium P. FIG. 18 illustrates the example in which the relative positions of the pair of first marks M1*a* and M1*b* and the second mark M2 deviate in the test pattern.

It is assumed that, although in the test pattern TP illustrated in FIG. 16A, the second mark M2 is expected to be located at the midpoint of the first marks M1*a* and M1*b* (ideal position) as described above, the deviation of ink landing position caused by the variations in amount of conveyance of the recording medium P deviates the position of the second mark M2 nearer to the first mark M1*a* as illustrated in FIG. 18. In the captured image based on this assumption, as illustrated in FIG. 18, the second mark M2 is at a distance a from the first mark M1*a* and at a distance b from the first mark M1*b*.

Even if a relative deviation between the pair of first marks M1*a* and M1*b* and the second mark M2 occurs, the actual distance between the first marks M1*a* and M1*b* is not changed because the pair of first marks M1*a* and M1*b* is formed under the same conditions (the same amount of conveyance and the same inclination). In other words, the actual distance corresponding to a distance a+b (the distance between the first marks M1*a* and M1*b*) illustrated in FIG. 18 is not changed even if a relative deviation between the pair of first marks M1*a* and M1*b* and the second mark M2 occurs.

Figure 19:
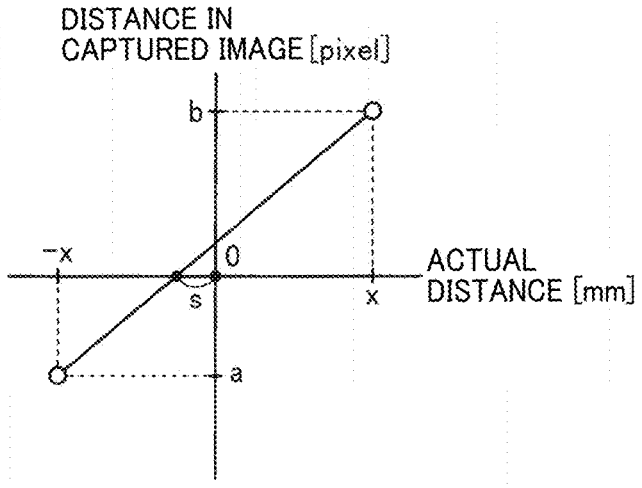
FIG. 19 is a graph of the amount of deviation of the second mark from the pair of first marks.

FIG. 19 is a diagram of the amount of deviation of the second mark M2 relative to the pair of first marks M1*a* and M1*b*. FIG. 19 illustrates a coordinate plane including the midpoint of the first marks M1*a* and M1*b* as an origin, the actual distance on a horizontal axis, and the distance in the captured image on a vertical axis. Each position of the first marks M1*a* and M1*b* are plotted on the coordinated plane. The example illustrated in FIG. 19 is on the assumption that a relative deviation illustrated in FIG. 18 occurs between the pair of first marks M1*a* and M1*b* and the second mark M2.

The inclination of the line connecting the plotted positions of the first marks M1*a* and M1*b* in FIG. 19 corresponds to the ratio between the distance between the first marks M1*a* and M1*b* in the captured image and the actual distance between the first marks M1*a* and M1*b*. In other words, the inclination of the line indicates the ratio between the distance in the captured image and the actual distance (image magnification). The position of the second mark M2 in the case where the relative deviation between the pair of first marks M1*a* and M1*b* and the second mark M2 does not occur is the origin. Accordingly, the distance s between the intersect of the line connecting the plotted positions of the first marks M1*a* and M1*b* and the horizontal axis and the origin represents the amount of deviation of the second mark M2 relative to the pair of first marks M1*a* and M1*b*.

The ratio between the distance in the captured image and the actual distance (the image magnification) varies according to a variation in the distance between the imaging unit 20 and the test pattern TP. The image forming apparatus 100 according to the present embodiment supports the recording medium P on which the test pattern TP is formed on the platen 16 having a rugged shape including the rib-shaped projections as described above. Thus, the rugged shape of the platen 16 varies the distance between the imaging unit 20 and the test pattern TP and may change the ratio.

Figure 20:
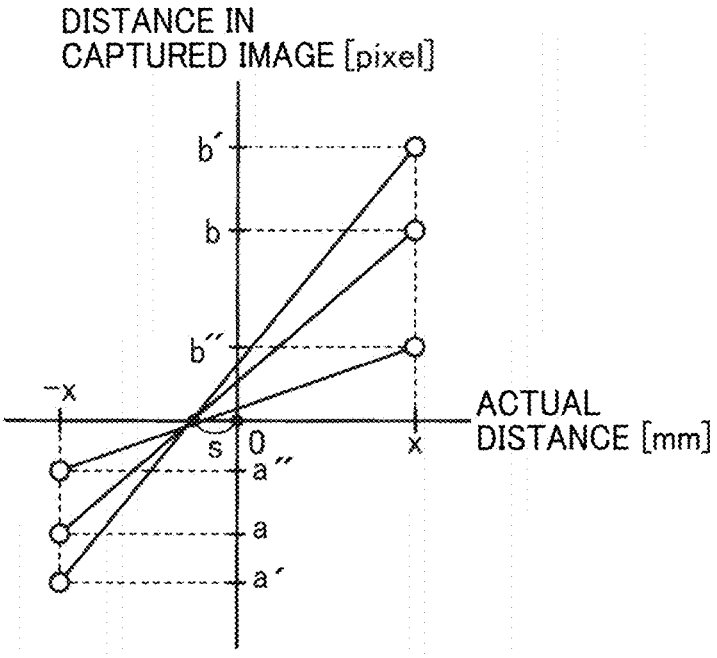
FIG. 20 is a diagram of the amount of deviation of the second mark from the pair of first marks when the distance between the imaging unit and the test pattern varies.

FIG. 20 is a diagram of the amount of deviation of the second mark M2 relative to the pair of first marks M1*a* and M1*b* when the distance between the imaging unit and the test pattern varies. When the distance between the imaging unit 20 and the test pattern TP decreases, the distance between the first mark M1*a* and the second mark M2 in the captured image has a value a' larger than the distance a illustrated in FIG. 18 and the distance between the first mark M1*b* and the second mark M2 in the captured image has a value b' larger than the distance b illustrated in FIG. 18. Therefore, the inclination of the line connecting the plotted positions of the first marks M1*a* and M1*b* increases in comparison with the inclination in the example in FIG. 19.

On the other hand, when the distance between the imaging unit 20 and the test pattern TP increases, the distance between the first mark M1*a* and the second mark M2 in the captured image has a value a" smaller than the distance a illustrated in FIG. 18 and the distance between the first mark M1*a* and the second mark M2 in the captured image has a value b" smaller than the distance b illustrated in FIG. 18. Thus, the inclination of the line connecting the plotted positions of the first marks M1*a* and M1*b* decreases in comparison with the inclination in the example in FIG. 19. However, the deviation amount s of the second mark M2 from the pair of first marks M1*a* and M1*b* is not changed even if the inclination of the line connecting the plotted positions of the first marks M1*a* and M1*b* varies.

The distance between the intersect of the line connecting the plotted positions of the first marks M1*a* and M1*b* and the vertical axis and the origin is the amount of deviation of the second mark M2 relative to the pair of first marks M1*a* and M1*b* in the captured image. As the distance between the imaging unit 20 and the test pattern TP decreases, the distance between the first marks M1*a* and M1*b* increases, and the amount of deviation in the captured image also increases at the same ratio. On the other hand, as the distance between the imaging unit 20 and the test pattern TP increases, the distance between the first marks M1*a* and M1*b* decreases, and the amount of deviation in the captured image also decreases at the same ratio. In other word, even if the distance between the imaging unit 20 and the test pattern TP varies, the ratio between the distance between the first marks M1*a* and M1*b* and the amount of deviation in the captured image does not change.

Referring back to FIG. 14, the actual distance calculator 114 of the CPU 110 calculates the actual distance of deviation (actual deviation amount) of the second mark M2 based on the actual distance between the first marks M1*a* and M1*b* and the ratio calculated with the ratio calculator 143. In other word, the actual distance calculator 114 multiplies the actual distance between the first and second nozzles 6A1 and 6A2 to form the first marks M1*a* and M1*b* (the distance H in FIG. 16B) by the ratio calculated with the ratio calculator 143 (the ratio s/h in FIG. 17) to calculate the actual distance of the deviation amount s of the second mark M2 relative to the pair of first marks M1*a* and M1*b* (H×s/h in FIGS. 16B and 17). The actual distance calculator 114 transmits the calculated actual distance to the adjusting unit 115.

The adjusting unit 115 of the CPU 110 calculates the correction amount of the parameter relating to the amount of conveyance of the recording medium P (controlled by the conveyance controller 116) in each of the scanning directions in which the carriage 5 moves, based on the actual distance (H×s/h) of deviation of the second mark M2 calculated by the actual distance calculator 114. Then, the adjusting unit 115 adjusts the parameter by the calculated correction amount. The parameter relating to the amount of conveyance of the recording medium P (hereinafter also simply "conveyance-related parameter") includes, for example, the parameter to control the rotation speed of the conveyance roller 152. The adjusting unit 115 transmits the adjustment value for the parameters to the control FPGA 120 in order to adjust, for example, the operation of the conveyance controller 116 to control the conveyance roller 152. This adjustment can improve the accuracy of the landing position of ink even when the recording head 6A inclines at different angles in the forward direction and backward direction.

[Operation of Image Forming Apparatus]

Figure 21A:
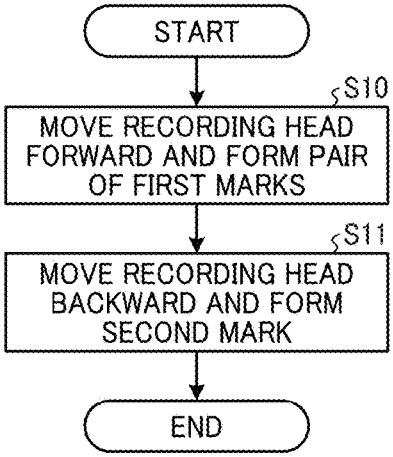
FIGS. 21A, 21B, and 21C are flowcharts of the operation for adjusting the amount of conveyance in the image forming apparatus according to Embodiment 1.
Figure 21B:
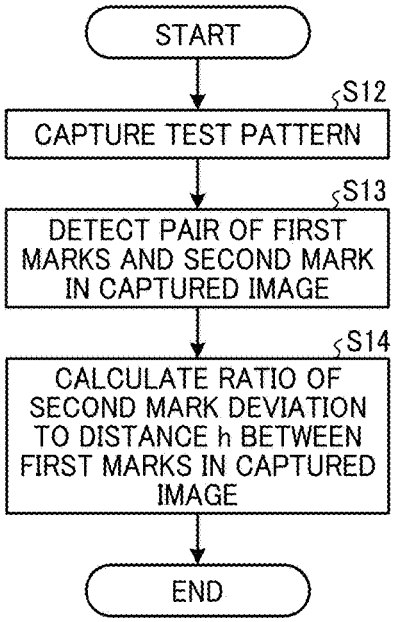
Figure 21C:
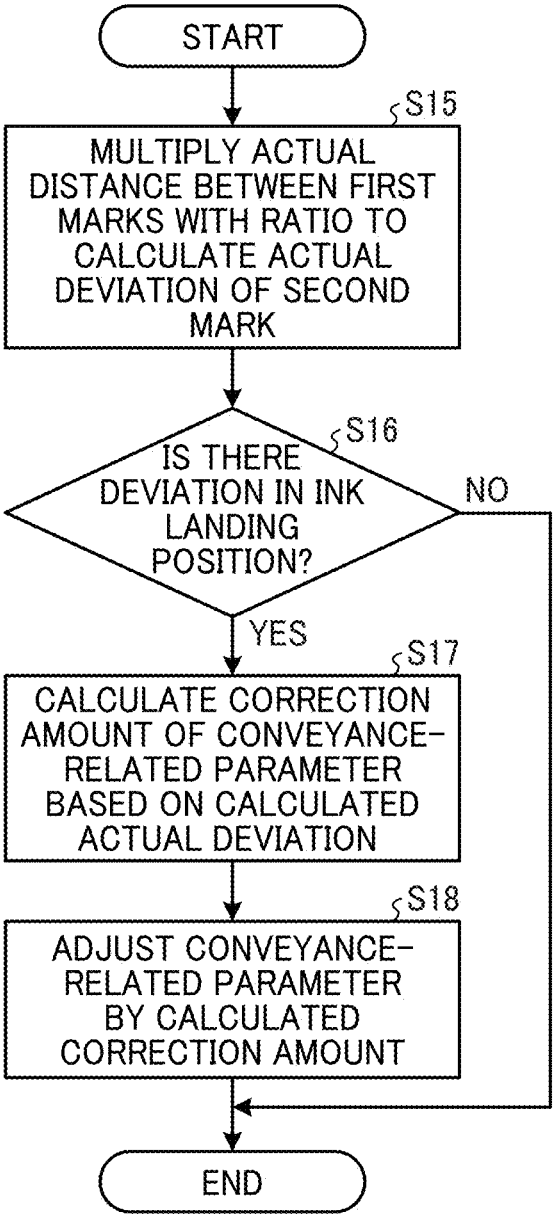

The operation of the image forming apparatus 100 for adjusting the amount of conveyance will be described, referring to FIGS. 21A, 21B, and 21C. FIGS. 21A, 21B, and 21C are flowcharts of the operation for adjusting the amount of conveyance in the image forming apparatus according to Embodiment 1. The steps S12 to S14 are performed by the imaging unit 20 controlled by the two-dimensional sensor CPU 140, and steps S10, S11, and S15 to S18 are controlled by the CPU 110.

Referring to FIG. 21A, after a recording medium P is set on the platen 16, at S10, the pattern forming unit 111 of the CPU 110 causes the recording head 6A to form the pair of first marks M1*a* and M1*b* on the recording medium P while moving in the forward direction.

At S11, the pattern forming unit 111 causes the recording head 6A to form the second mark M2 on the recording medium P with a nozzle at a distance A from the nozzle that has formed the first mark M1*a* while moving the recording head 6A in the backward direction. As a result, the test pattern TP including the pair of first marks M1*a* and M1*b* and the second mark M2 is formed.

Referring to FIG. 21B, at S12, the two-dimensional sensor 27 of the imaging unit 20 captures an image of the test pattern TP formed at steps S10 and S11, and outputs the captured image of the test pattern TP. At 513, the position detector 142 of the two-dimensional sensor CPU 140 detects the position of each of the pair of first marks M1*a* and M1*b* and the second mark M2 in the captured image.

At S14, the ratio calculator 143 of the two-dimensional sensor CPU 140 calculates the ratio between the amount of deviation of the second mark M2 (i.e., second mark deviation in FIG. 21B) in the captured image and the distance h between the first marks M1*a* and M1*b* in the captured image, using the detected positions of the pair of first marks M1*a* and M1*b* and the second mark M2 in the captured image.

Referring to FIG. 21C, at S15, the actual distance calculator 114 of the CPU 110 multiplies, with the ratio, the actual distance between the first marks M1*a* and M1*b* (distance H between the first and second nozzles 6A1 and 6A2 to form the first marks M1*a* and M1*b*), using the pattern data used to form the test pattern TP at steps S10 and S11 and the ratio calculated at step S14 to calculate the actual deviation (actual distance of deviation) of the second mark M2.

At S16, the adjusting unit 115 of the CPU 110 determines, based on the actual distance of deviation of the second mark M2 calculated at step S15, whether the landing position of ink has deviated. When the adjusting unit 115 determines that the landing position of ink has not deviated (No at S16), a sequence of operations is completed.

On the other hand, when the adjusting unit 115 determines that the landing position has deviated (Yes at S16), at S17, the adjusting unit 115 calculates the correction amount of the conveyance-related parameter based on the actual distance of deviation of the second mark M2 calculated at S15. At S18, the adjusting unit 115 adjusts the conveyance-related parameter, using the calculated correction amount. Then, a sequence of operations is completed.

As described above, the image forming apparatus 100 according to Embodiment 1 forms the pair of first marks M1*a* and M1*b* while the recording head 6A moves in the forward direction and forms the second mark M2 while the recording head 6A moves in the backward direction, thereby forming the test pattern TP including the pair of first marks M1*a* and M1*b* and the second mark M2 on the recording medium P. Then, the image forming apparatus 100 captures an image of the formed test pattern TP with the imaging unit 20. Next, the image forming apparatus 100 detects the position of each of the pair of first marks M1*a* and M1*b* and the second mark M2 of the test pattern TP in the captured image. Then, the image forming apparatus 100 calculates the ratio between the distance between the first marks M1*a* and M1*b* in the captured image and the amount of deviation of the second mark M2 in the captured image, and multiplies, with the ratio, the actual distance between the first marks M1*a* and M1*b* (distance H between the first and second nozzles 6A1 and 6A2 to form the first marks M1*a* and M1*b*) to calculate the actual distance of deviation of the second mark M2. Then, the image forming apparatus 100 adjusts the parameter relating to the amount of conveyance of the recording medium P according to the actual distance of deviation of the second mark M2.

Accordingly, the image forming apparatus 100 according to Embodiment 1 can appropriately calculate the actual distance corresponding to the amount of deviation of the landing position of ink based on the captured image of the test pattern TP even if the distance between the imaging unit 20 and the test pattern TP varies. Thus, the image forming apparatus 100 adjusts the parameter relating to the amount of conveyance of the recording medium P in each of the scanning directions in which the carriage 5 moves according to the amount of deviation. This adjustment can improve the accuracy of the landing position of ink and thus can improve the image quality.

[Another Method for Calculating Actual Distance of Deviation of Mark]

In the embodiment described above, the ratio between the distance between the first marks M1*a* and M1*b* in the captured image and the amount of deviation of the second mark M2 in the captured image is calculated. Then, the actual distance between the first marks M1*a* and M1*b* is multiplied by the calculated ratio to obtain the actual distance of deviation of the second mark M2. Alternatively, the following method may be used to calculate the actual distance of deviation of the second mark M2.

The ratio calculator 143 calculates the ratio between the distance between the first marks M1*a* and M1*b* in the captured image and the distance between one of the first marks M1*a* and M1*b* and the second mark M2 in the captured image. For example, when FIG. 18 is referred to, the calculated ratio in this example is represented as a/(a+b) or b/(a+b).

Then, the actual distance calculator 114 multiplies the actual distance between the first marks M1*a* and M1*b* by the ratio calculated with the ratio calculator 143 to calculate the actual distance between one of the first marks M1*a* and M1*b* and the second mark M2. Then, the actual distance calculator 114 subtracts the calculated actual distance between one of the first marks M1*a* and M1*b* and the second mark M2 from the distance between one of the first marks M1*a* and M1*b* and the second mark M2 in the pattern data used to form the test pattern TP in order to calculate the actual distance of deviation of the second mark M2. Then, the parameter relating to the amount of conveyance of the recording medium P can be adjusted in each of the scanning directions in which the carriage 5 moves based on the calculated actual distance of deviation of the second mark M2.

[Modification of Test Pattern]

The test pattern TP used in the present embodiment is not limited to the example in FIGS. 16A and 16B, and may be variously changed. A modification of the test pattern TP will be described below.

The test pattern TP illustrated in FIGS. 16A and 16B includes only the pair of first marks M1*a* and M1*b* and the second mark M2. The test pattern TP, however, may further include a reference line formed under a condition different from the condition under which the pair of first marks M1*a* and M1*b* and the second mark M2 are formed. The reference line is used to locate the pair of first marks M1*a* and M1*b* and the second mark M2. The reference line may be a reference frame surrounding the pair of first marks M1*a* and M1*b* and the second mark M2.

Figure 22:
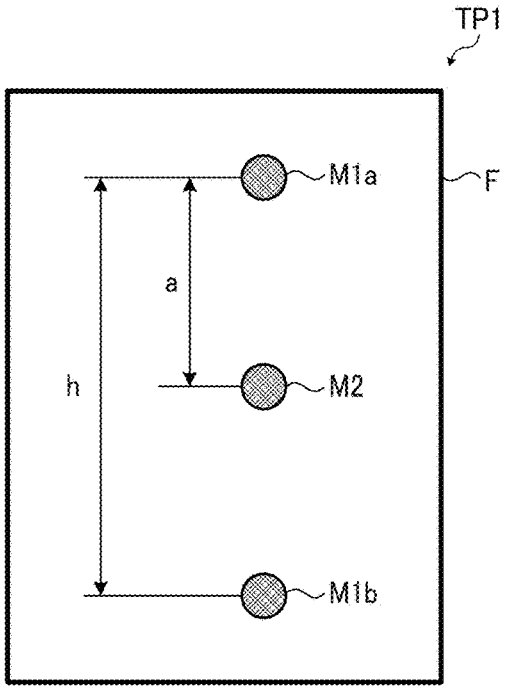
FIG. 22 is a diagram of an example of a test pattern and a reference frame according to an embodiment.

FIG. 22 illustrates an example of a test pattern and a reference frame. A test pattern TP1 illustrated in FIG. 22 includes the test pattern TP illustrated in FIG. 16A and a reference frame F surrounding the test pattern TP. The reference frame F is formed under a condition different from the condition under which the marks of the test pattern TP are formed. For example, the reference frame F is formed with a line having a thickness different from the thickness of the marks of the test pattern TP. This allows the reference frame F to be distinguished from the test pattern TP including the pair of first marks M1*a* and M1*b* and the second mark M2 when the positions of the first marks M1*a* and M1*b* and the second mark M2 in the captured image are detected.

The image forming apparatus 100 detects the position of the reference frame F after obtaining the captured image. Then, the image forming apparatus 100 detects the positions of the pair of first marks M1*a* and M1*b* and the second mark M2 based on the position of the reference frame F. This enables the image forming apparatus 100 to easily detect the positions of the pair of first marks M1*a* and M1*b* and the second mark M2 even if the test pattern TP is formed at a deviated position in the captured image.

The reference frame F will be described here. When an image of the reference frame F is captured with the imaging unit 20 that does not include the reference chart 300 illustrated in FIG. 9 (see FIGS. 10 and 11), the image capture range is preferably set so that the reference frame F is positioned near the center of the image capture range. On the other hand, when an image of the reference frame F is captured with the imaging unit 20 having the reference chart 300 (see FIGS. 4 to 8), the image capture range is preferably set to satisfy the following conditions: Conditions 1) the reference frame F is positioned to be captured from the opening 53 without the reference chart 300, and Condition 2) the reference frame F is near the optical axis of the light emitted from the light source 58.

Figure 23A:
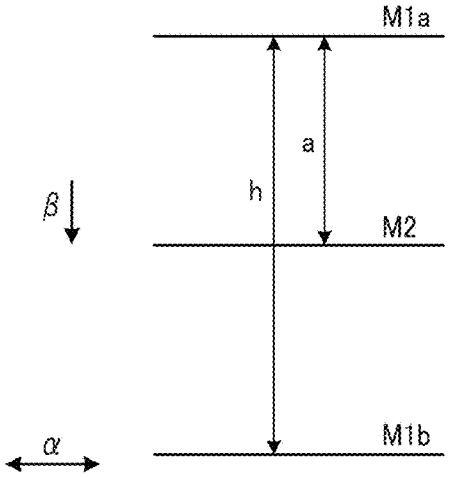
FIGS. 23A and 23B are diagrams of a test pattern including linear marks according to an embodiment.
Figure 23B:
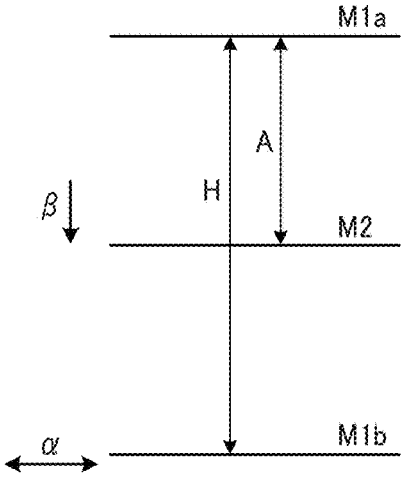

Alternatively, the pair of first marks M1*a* and M1*b* and the second mark M2 may be formed as lines extending in the main scanning direction in which the carriage 5 moves. FIGS. 23A and 23B illustrate an example of a test pattern including linear marks. For example, as illustrated in FIGS. 23A and 23B, the pair of first marks M1*a* and M1*b* and the second mark M2 may be formed into lines extending in the main scanning direction (indicated by arrow α in the drawing), and the second mark M2 may be formed between the first marks M1*a* and M1*b*. Forming marks into lines described above facilitates the detection of the positions of the marks in the captured image.

Embodiment 2

The image forming apparatus according to Embodiment 1 captures an image of the test pattern TP including the second mark M2 positioned between the first marks M1*a* and M1*b* and calculates the actual distance of deviation of the second mark M2 based on the captured image. By contrast, in the present embodiment, the first mark M1*b* and the second mark M2 are formed with the second nozzle 6A2 (or the third nozzle 6A3) at a predetermined distance from the first nozzle 6A1 to form the first mark M1*a*. An image forming apparatus according to the present embodiment captures an image of the test pattern TP including such first marks M1*a* and M1*b* and second mark M2 and calculates the actual distance of deviation of the second mark M2 based on the captured image.

The image forming apparatus 100 according to the present embodiment is similar in hardware structure and functional configuration illustrated in FIGS. 13 and 14. Differences from Embodiment 1 are described with reference to FIG. 14.

Similar to Embodiment 1, the pattern forming unit 111 of the CPU 110 causes the image forming device described above to perform the image forming operation according to, for example, the pattern data in order to form the test pattern TP on the recording medium P.

The test pattern TP according to the present embodiment is a set of marks including a pair of first marks M1*a* and M1*b* and a second mark M2. In the present embodiment, a description is given of an example in which the pattern forming unit 111 forms the pair of first marks M1*a* and M1*b* on the recording medium P while the recording head 6A moves in the forward direction and forms the second mark M2 on the recording medium P while the recording head 6A moves in the backward direction. Note that, similar to Embodiment 1, the marks may be formed in either order, and thus the pattern forming unit 111 may form the second mark M2 while the recording head 6A moves in the forward direction and form the pair of first marks M1*a* and M1*b* while the recording head 6A moves in the backward direction. Additionally, in the present embodiment, when the first nozzle 6A1 forms the first mark M1*a*, the first mark M1*b* and the second mark M2 are formed with a nozzle (e.g., the second nozzle 6A2 or the third nozzle 6A3) disposed at a predetermined distance from the first nozzle in the sub-scanning direction, in which the recording medium P is conveyed.

Figure 24A:
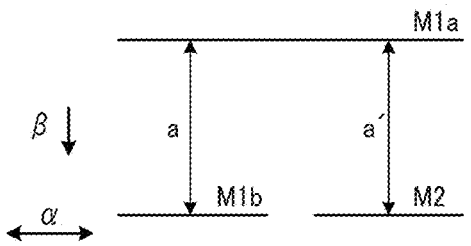
FIGS. 24A and 24B are diagrams of a test pattern on a recording medium according to an embodiment.
Figure 24B:
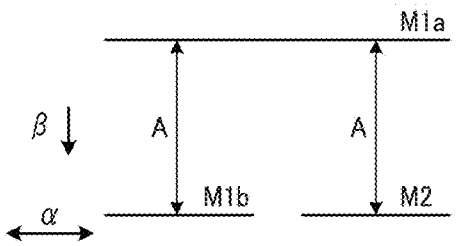

FIGS. 24A and 24B illustrate an example of the test pattern on a recording medium. FIG. 24A illustrates the relative positions of the marks of the captured image. FIG. 24B illustrates theoretical relative positions of the marks. The test pattern TP illustrated in FIGS. 24A and 24B is a set of marks including the pair of first marks M1*a* and M1*b* and the second mark M2. The pair of first marks M1*a* and M1*b* and the second mark M2 are lines and extend in the main scanning direction indicated by arrow a in the drawings, in which the carriage 5 moves.

As illustrated in FIG. 24B, in the test pattern TP according to the present embodiment, in theory, the first mark M1*b* and the second mark M2 are equally at a distance A from the first mark M1*a* in the sub-scanning direction indicated by arrow β in the drawings. In the captured image of the test pattern TP on the recording medium P illustrated in FIG. 24A, the first mark M1*b* is at the distance a from the first mark M1*a*, and the second mark M2 is at a distance a' from the first mark M1*a*.

A method for forming the test pattern TP will be described next. To form the test pattern TP illustrated in FIG. 24A, for example, the pair of first marks M1*a* and M1*b* is formed on the recording medium P in the forward movement and the second mark M2 is formed in the direction opposite to the direction in which the pair of first marks M1*a* and M1*b* is formed. The first mark M1*b* and the second mark M2 are formed with a nozzle (e.g., the second nozzle 6A2 or the third nozzle 6A3) at the distance A from the first nozzle 6A1 to form the first mark M1*a*.

Accordingly, when the recording head 6A inclines at the same angle in the forward movement and the backward movement, the first mark M1*b* and the second mark M2 are equally away from the first mark M1*a*. By contrast, when the recording head 6A inclines differently between the forward movement and the backward movement, the distance a from the first mark M1*a* differs between the first mark M1*b* and the second mark M2. The difference is the deviation. Note that, even when the nozzle to form the first mark M1*b* and the second mark M2 has a bend, the deviation of the first mark M1*b* and the second mark M2 does not include the effect of the bend of the nozzle because the nozzle is conceivably bent similarly in the forward movement and the backward movement of the recording head 6A.

The ratio calculator 143 of the two-dimensional sensor CPU 140 calculates the ratio between the distance between the first marks M1*a* and M1*b* in the captured image and the amount of deviation of the second mark M2 in the captured image based on the positions of the pair of first marks M1*a* and M1*b* and the second mark M2 in the captured image. At that time, the ratio calculator 143 according to the present embodiment regards, as the amount of deviation of the second mark M2, the difference between the distance a between the first marks M1*a* and M1*b* and the distance a' between the first mark M1*a* and the second mark M2 in the captured image. Accordingly, the ratio calculator 143 calculates the ratio between the distance between the first marks M1*a* and M1*b* and the difference (e.g., a−a').

For example, in the case illustrated in FIG. 24A, the ratio calculator 143 calculates the distance a between the first marks M1*a* and M1*b*, based on the captured image of the pair of first marks M1*a* and M1*b* and the second mark M2. Subsequently, the ratio calculator 143 deducts, from the distance a between the first marks M1*a* and M1*b* in the captured image, the distance a' between the first mark M1*a* and the second mark M2 to obtain the difference (a−a'). The ratio calculator 143 then divides the difference by the distance a to obtain the ratio expressed as (a−a')/a. Subsequently, the actual distance calculator 114 multiplies the actual distance A between the nozzles to form the first mark M1*a* and the first mark M1*b* by the calculated ratio expressed as (a−a')/a to calculate the actual distance of the deviation amount s of the second mark M2 from the pair of first marks M1*a* and M1*b* represented as (a−a')A/a.

[Operation of Image Forming Apparatus]

Figure 25A:
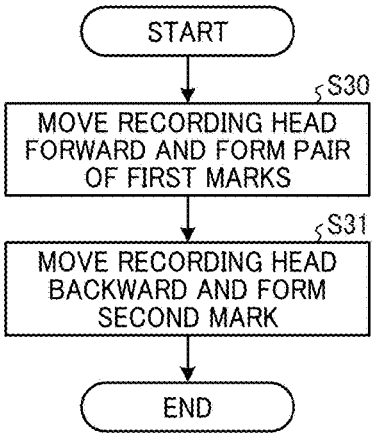
FIGS. 25A, 25B, and 25C area flowcharts of the operation for adjusting the amount of conveyance in an image forming apparatus according to Embodiment 2.
Figure 25B:
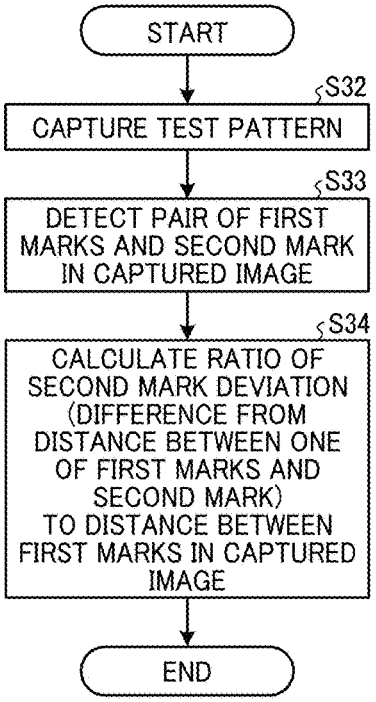
Figure 25C:
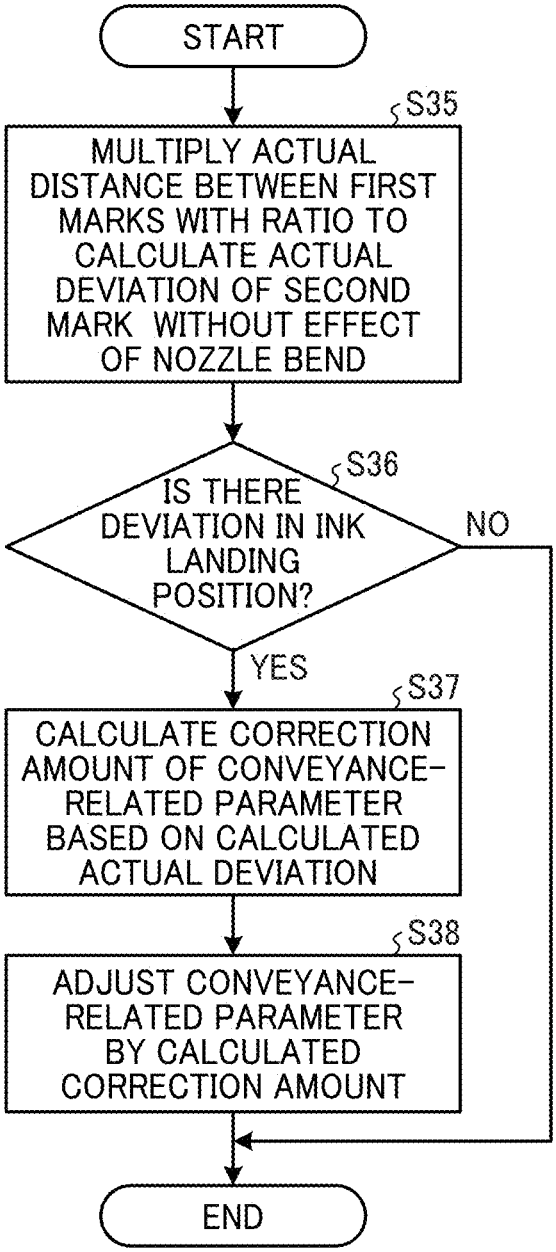

The operation of the image forming apparatus 100 for adjusting the amount of conveyance will be described, referring to FIGS. 25A, 25B, and 25C. FIGS. 25A, 25B, and 25C are flowcharts of the operation for adjusting the amount of conveyance in the image forming apparatus according to Embodiment 2.

The process of formation of the pair of first marks M1*a* and M1*b* to detection of the marks (steps S30 and S31 in FIG. 25A and steps S32 and S33 in FIG. 25B) are similar to those in Embodiment 1 (steps S10 and S11 in FIG. 21A and steps S12 and S13 in FIG. 21B). Thus, redundant descriptions are omitted.

Subsequently, the ratio calculator 143 of the two-dimensional sensor CPU 140 performs ratio calculation using the detected position of the pair of first marks M1*a* and M1*b* and the position of the second mark M2 in the captured image. That is, at S34 in FIG. 25B, the ratio calculator 143 calculates, as the amount of deviation of the second mark M2, the difference between the distance a between the first marks M1*a* and M1*b* and the distance a' between the first mark M1*a* and the second mark M2 in the captured image. The ratio calculator 143 then calculates the ratio between the distance a between the first marks M1*a* and M1*b* and the calculated difference (a−a').

Referring to FIG. 25C, at S35, the actual distance calculator 114 of the CPU 110 multiplies the actual distance between the first marks M1*a* and M1*b* by the ratio, using the pattern data used to form the test pattern TP at steps S30 and S31 and the ratio calculated at step S34 to calculate the actual deviation (actual distance of deviation) of the second mark M2 from which the effect of nozzle bend of eliminated.

The processing starting from determination of deviation and adjustment of the conveyance-related parameter (steps S36 to S38) are similar to the processing performed in steps S16 to S18 illustrated in FIG. 21C of Embodiment 1. Thus, redundant descriptions are omitted.

As described above, the image forming apparatus 100 according to Embodiment 2 forms the pair of first marks M1*a* and M1*b* while the recording head 6A moves in the forward direction and forms the second mark M2 while the recording head 6A moves in the backward direction to form the test pattern TP including the pair of first marks M1*a* and M1*b* and the second mark M2 on the recording medium P. Then, the image forming apparatus 100 captures an image of the formed test pattern TP with the imaging unit 20. Next, the image forming apparatus 100 detects the position of each of the pair of first marks M1*a* and M1*b* and the second mark M2 of the test pattern TP in the captured image. Then, the image forming apparatus 100 calculates the ratio between the distance between the first marks M1*a* and M1*b* in the captured image and the amount of deviation of the second mark M2 in the captured image, and multiplies the distance between the nozzles to form the first marks M1*a* and M1*b* by the ratio to calculate the actual distance of deviation of the second mark M2. Then, the image forming apparatus 100 adjusts the parameter relating to the amount of conveyance of the recording medium P according to the actual distance of deviation of the second mark M2.

Accordingly, the image forming apparatus 100 according to Embodiment 2 can appropriately calculate the actual distance of deviation of the landing position of ink based on the captured image of the test pattern TP even if the distance between the imaging unit 20 and the test pattern TP varies. Thus, the image forming apparatus 100 adjusts the parameter relating to the amount of conveyance of the recording medium P in each of the scanning directions in which the carriage 5 moves according to the amount of deviation. This adjustment can improve the accuracy of the landing position of ink and thus can improve the image quality.

Additionally, the image forming apparatus 100 according to Embodiment 2 forms the pair of first marks M1*a* and M1*b* and the second mark M2 of the test pattern TP as lines extending in the main scanning direction in which the carriage 5 moves. Additionally, in the present embodiment, when the first nozzle 6A1 forms the first mark M1*a*, the first mark M1*b* and the second mark M2 are formed with the second nozzle disposed at a predetermined distance from the first nozzle 6A1 in the sub-scanning direction, in which the recording medium P is conveyed. Then, the image forming apparatus 100 calculates, as the deviation of the second mark M2, the difference between the distance a between the first marks M1*a* and M1*b* and the distance a' between the first mark M1*a* and the second mark M2 in the captured image. Accordingly, the image forming apparatus 100 can calculate the actual distance of deviation of the second mark M2 without the effect of the nozzle bend.

[Modification of Test Pattern]

The test pattern TP used in the present embodiment is not limited to the example in FIGS. 24A and 24B, and may be variously changed. A modification of the test pattern TP will be described below.

The test pattern TP illustrated in FIGS. 24A and 24B includes only the pair of first marks M1*a* and M1*b* and the second mark M2. The test pattern TP, however, may further include a reference line formed under a condition different from the condition under which the pair of first marks M1*a* and M1*b* and the second mark M2 are formed. The reference line is used to locate the pair of first marks M1*a* and M1*b* and the second mark M2. The reference line may be a reference frame surrounding the pair of first marks M1*a* and M1*b* and the second mark M2.

Figure 26:
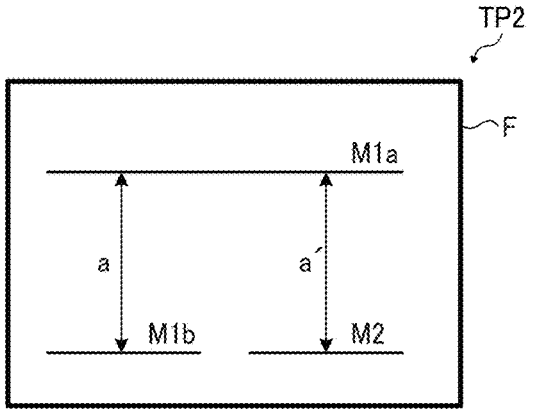
FIG. 26 is a diagram of an example of a test pattern and a reference frame according to an embodiment.

FIG. 26 illustrates an example of a test pattern and a reference frame. A test pattern TP2 illustrated in FIG. 26 includes the test pattern TP illustrated in FIG. 24A and a reference frame F surrounding the test pattern TP. The reference frame F is formed under a condition different from the condition under which the marks of the test pattern TP are formed. For example, the reference frame F is formed with a line having a thickness different from the thickness of the marks of the test pattern TP. This allows the reference frame F to be distinguished from the test pattern TP including the pair of first marks M1*a* and M1*b* and the second mark M2 when the positions of the first marks M1*a* and M1*b* and the second mark M2 in the captured image are detected.

The image forming apparatus 100 detects the position of the reference frame F after obtaining the captured image. Then, the image forming apparatus 100 detects the positions of the pair of first marks M1*a* and M1*b* and the second mark M2 based on the position of the reference frame F. This enables the image forming apparatus 100 to easily detect the positions of the pair of first marks M1*a* and M1*b* and the second mark M2 even if the test pattern TP is formed at a deviated position in the captured image.

Embodiment 3

The image forming apparatus according to Embodiment 1 captures an image of the test pattern TP including the second mark M2 formed while the recording head 6A moves in the direction opposite the direction in which the recording head 6A moves to form the first marks M1*a* and M1*b* and calculates the actual distance of deviation of the second mark M2 based on the captured image. By contrast, the image forming apparatus according to the present embodiment forms a test pattern TP including a third mark formed while the carriage moves in the direction identical to the direction in which the carriage moves to form the first marks M1*a* and M1*b* and calculates the actual distance of deviation of the second mark M2 based on a captured image of such a test pattern.

The image forming apparatus 100 according to the present embodiment is similar in hardware structure and functional configuration illustrated in FIGS. 13 and 14. Differences from Embodiment 1 are described with reference to FIG. 14.

Similar to Embodiment 1, the pattern forming unit 111 of the CPU 110 causes the image forming device described above to perform the image forming operation according to, for example, the pattern data in order to form the test pattern TP on the recording medium P.

The test pattern TP according to the present embodiment is a set of marks including a pair of first marks M1*a* and M1*b*, a second mark M2, and a third mark M3. In the present embodiment, a description is given of an example in which the pattern forming unit 111 forms the pair of first marks M1*a* and M1*b* and the third mark M3 on the recording medium P while the recording head 6A moves in the forward direction and forms the second mark M2 on the recording medium P while the recording head 6A moves in the backward direction. Note that, similar to Embodiment 1, the marks may be formed in either order, and thus the pattern forming unit 111 may form the second mark M2 while the recording head 6A moves in the forward direction and form the pair of first marks M1*a* and M1*b* and the third mark M3 while the recording head 6A moves in the backward direction. Additionally, in the present embodiment, when the first nozzle 6A1 forms the first mark M1*a*, the second mark M2 and the third mark M3 are formed with a nozzle (e.g., the third nozzle 6A3) disposed at a predetermined distance (second distance) from the first nozzle 6A1 in the sub-scanning direction, in which the recording medium P is conveyed.

Figure 27A:
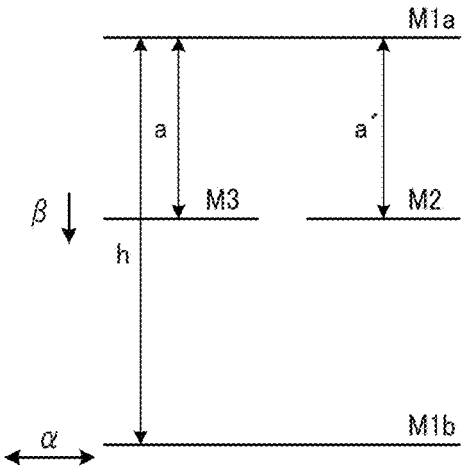
FIGS. 27A and 27B are diagrams of a test pattern on a recording medium according to an embodiment.
Figure 27B:
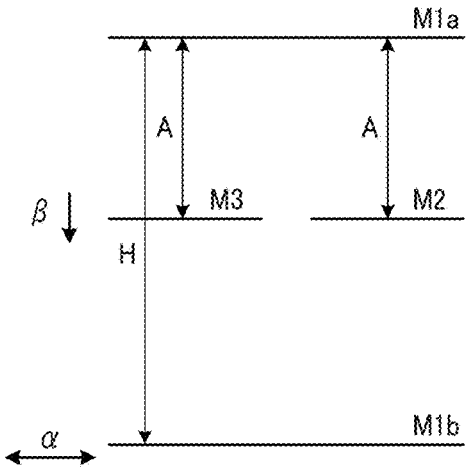

FIGS. 27A and 27B illustrate an example of the test pattern on a recording medium. FIG. 27A illustrates the relative positions of the marks in the captured image. FIG. 27B illustrates theoretical relative positions of the marks. The test pattern TP illustrated in FIGS. 27A and 27B is a set of marks including the pair of first marks M1*a* and M1*b*, the second mark M2, and the third mark M3. The pair of first marks M1*a* and M1*b*, the second mark M2, and the third mark M3 are lines and extend in the main scanning direction indicated by arrow α in the drawings, in which the carriage 5 moves.

As illustrated in FIG. 27B, in the test pattern TP according to the present embodiment, in theory, the second mark M2 and the third mark M3 are equally at a distance A from the first mark M1*a* in the sub-scanning direction indicated by arrow β in the drawings. The first mark M1*b* in theory is at a distance H (identical to the first distance between the first and second nozzles 6A1 and 6A2) from the first mark M1*a* in the sub-scanning direction. In the captured image of the test pattern TP on the recording medium P illustrated in FIG. 27A, the first mark M1*b* is at a distance h from the first mark M1*a*, the second mark M2 is at a distance a' from the first mark M1*a*, and the third mark M3 is at a distance a from the first mark M1*a*.

A method for forming the test pattern TP will be described next. To form the test pattern TP illustrated in FIG. 27A, for example, the pair of first marks M1*a* and M1*b* and the third mark M3 are formed on the recording medium P in the forward movement and the second mark M2 is formed in the direction opposite to the direction in which the pair of first marks M1*a* and M1*b* and the third mark M3 are formed. The second mark M2 and the third mark M3 are formed with the nozzle at the distance A from the first nozzle 6A1 to form the first mark M1*a*.

Accordingly, when the recording head 6A inclines at the same angle in the forward movement and the backward movement, the second mark M2 and the third mark M3 are positioned at an equal distance from the first mark M1*a*. By contrast, when the recording head 6A inclines differently between the forward movement and the backward movement, the distance a' between the first mark M1*a* and the second mark M2 differs from the distance a between the first mark M1*a* and the third mark M3. The difference in the distance from the first mark M1*a* is the deviation of the second mark M2. Note that, even when the nozzle to form the second mark M2 and the third mark M3 has a bend, the difference in the distance from the first mark M1*a* between the second mark M2 and the third mark M3 does not include the effect of the bend of the nozzle because the nozzle is conceivably bent similarly in the forward movement and the backward movement of the recording head 6A.

The ratio calculator 143 of the two-dimensional sensor CPU 140 calculates, based on the positions of the pair of first marks M1*a* and M1*b*, the second mark M2, and the third mark M3 in the captured image, the ratio between the distance h between the first marks M1*a* and M1*b* in the captured image and the amount of deviation of the second mark M2 in the captured image. At that time, the ratio calculator 143 according to the present embodiment regards, as the amount of deviation of the second mark M2, the difference between the distance a' between the first mark M1*a* and the second mark M2 and the distance a between the first mark M1*a* and the third mark M3 in the captured image. Accordingly, the ratio calculator 143 calculates the ratio between the distance h between the first marks M1*a* and M1*b* and the difference (e.g., a−a').

For example, in the case illustrated in FIG. 27A, the ratio calculator 143 calculates the distance h between the first marks M1*a* and M1*b*, based on the captured image of the first marks M1*a* and M1*b* and the second mark M2. Subsequently, the ratio calculator 143 calculates the difference (a−a') between the distance a' between the first mark M1*a* and the second mark M2 and the distance a between the first mark M1*a* and the third mark M3 in the captured image. The ratio calculator 143 then divides the difference by the distance h to obtain the ratio expressed as (a−a')/h. Subsequently, the actual distance calculator 114 multiplies the actual distance H between the first and second nozzles 6A1 and 6A2 to form the first mark M1*a* and the first mark M1*b* by the calculated ratio expressed as (a−a')/h to calculate the actual distance of the deviation amount s of the second mark M2 relative to the pair of first marks M1*a* and M1*b* represented as (a−a')H/h.

[Operation of Image Forming Apparatus]

Figure 28A:
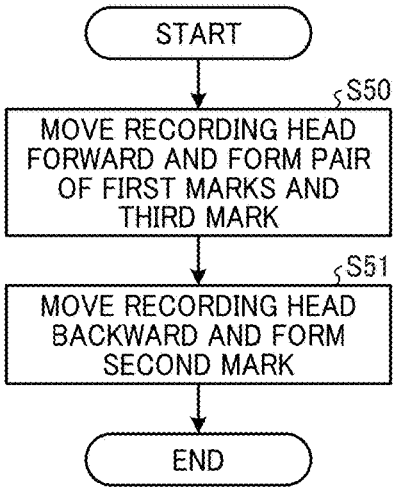
FIGS. 28A, 28B, and 28C are flowcharts of the operation for adjusting the amount of conveyance in the image forming apparatus according to Embodiment 3.
Figure 28B:
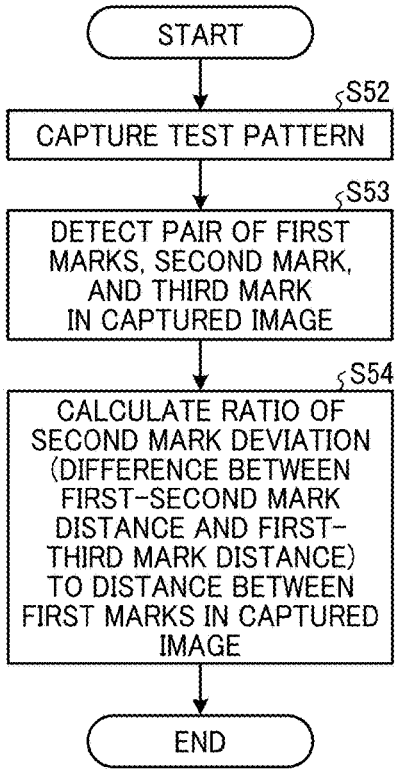
Figure 28C:
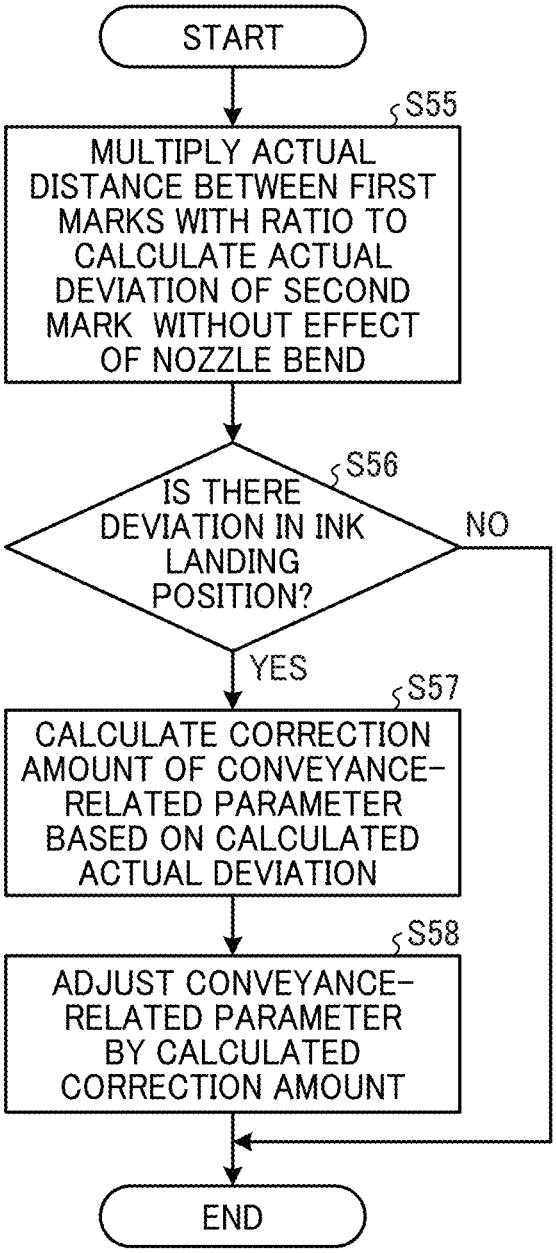

The operation of the image forming apparatus 100 for adjusting the amount of conveyance will be described, referring to FIGS. 28A, 28B, and 28C. FIGS. 28A, 28B, and 28C are flowcharts of the operation for adjusting the amount of conveyance in the image forming apparatus according to Embodiment 3.

Referring to FIG. 28A, after a recording medium P is set on the platen 16, at S50, the pattern forming unit 111 of the CPU 110 causes the recording head 6A to form the pair of first marks M1*a* and M1*b* and the third mark M3 on the recording medium P while moving in the forward direction. The third mark M3 is formed with the third nozzle 6A3 at the distance A from the first nozzle 6A1 to form the first mark M1*a*.

At S51, the pattern forming unit 111 causes the recording head 6A to form the second mark M2 on the recording medium P with the nozzle (e.g., the third nozzle 6A3) at the distance A from the first nozzle 6A1 that has formed the first mark M1*a* while moving the recording head 6A in the backward direction. As a result, the test pattern TP including the pair of first marks M1*a* and M1*b*, the second mark M2, and the third mark M3 is formed.

Referring to FIG. 28B, at S52, the two-dimensional sensor 27 of the imaging unit 20 captures an image of the test pattern TP formed at steps S50 and S51, and outputs the captured image of the test pattern TP. At S53, the position detector 142 of the two-dimensional sensor CPU 140 detects the position of each of the pair of first marks M1*a* and M1*b*, the second mark M2, and the third mark M3 in the captured image.

Subsequently, the ratio calculator 143 of the two-dimensional sensor CPU 140 performs ratio calculation using the detected positions of the pair of first marks M1*a* and M1*b*, the second mark M2, and the third mark M3 in the captured image. That is, at S54, the ratio calculator 143 calculates, as the amount of deviation of the second mark M2, the difference between the distance a' between the first mark M1*a* and the second mark M2 and the distance a between the first mark M1*a* and the third mark M3 in the captured image. The ratio calculator 143 then calculates the ratio between the distance h between the first marks M1*a* and M1*b* in the captured image and the calculated difference (a−a') in the captured image.

Referring to FIG. 28C, at S55, the actual distance calculator 114 of the CPU 110 multiplies the actual distance between the first marks M1*a* and M1*b* by the ratio, using the pattern data used to form the test pattern TP at steps S50 and S51 and the ratio calculated at step S54 to calculate the actual deviation (actual distance of deviation) of the second mark M2 from which the effect of nozzle bend of eliminated.

The processing starting from determination of deviation and adjustment of the conveyance-related parameter (steps S56 to S58) are similar to the processing performed in steps S16 to S18 illustrated in FIG. 21C of Embodiment 1. Thus, redundant descriptions are omitted.

As described above, the image forming apparatus 100 according to Embodiment 3 forms the pair of first marks M1*a* and M1*b* and the third mark M3 while the recording head 6A moves in the forward direction and forms the second mark M2 while the recording head 6A moves in the backward direction to form the test pattern TP including the pair of first marks M1*a* and M1*b*, the second mark M2, and the third mark M3 on the recording medium P. Then, the image forming apparatus 100 captures an image of the formed test pattern TP with the imaging unit 20. Next, the image forming apparatus 100 detects the position of each of the pair of first marks M1*a* and M1*b*, the second mark M2, and the third mark M3 of the test pattern TP in the captured image. Then, the image forming apparatus 100 calculates the ratio between the distance between the first marks M1*a* and M1*b* in the captured image and the amount of deviation of the second mark M2 in the captured image, and multiplies the actual distance between the nozzles 6A1 and 6A2 to form the first marks M1*a* and M1*b* by the ratio to calculate the actual distance of deviation of the second mark M2. Then, the image forming apparatus 100 adjusts the parameter relating to the amount of conveyance of the recording medium P according to the actual distance of deviation of the second mark M2.

Accordingly, the image forming apparatus 100 according to Embodiment 3 can appropriately calculate the actual distance of deviation of the landing position of ink based on the captured image of the test pattern TP even if the distance between the imaging unit 20 and the test pattern TP varies. Then, the image forming apparatus 100 adjusts the parameter relating to the amount of conveyance of the recording medium P in each of the scanning directions in which the carriage 5 moves according to the amount of deviation. This adjustment can improve the accuracy of the landing position of ink and thus can improve the image quality.

Additionally, the image forming apparatus 100 according to Embodiment 3 forms the pair of first marks M1*a* and M1*b* and the second mark M2 of the test pattern TP as lines extending in the main scanning direction in which the carriage 5 moves. Additionally, in the present embodiment, when the first mark M1*a* is formed with the first nozzle 6A1, the second mark M2 and the third mark M3 are formed with the nozzle disposed at a predetermined distance from the first nozzle 6A1 in the sub-scanning direction, in which the recording medium P is conveyed. Then, the image forming apparatus 100 calculates, as the deviation of the second mark M2, the difference between the distance from the first mark M1*a* to the second mark M2 and the distance from the first mark M1*a* to the third mark M3 in the captured image, and calculates the actual distance of the deviation, using the ratio between the distance h between the first marks M1*a* and M1*b* and the calculated difference. Accordingly, the image forming apparatus 100 can calculate the actual distance of deviation of the second mark M2 without the effect of the nozzle bend.

[Modification of Test Pattern]

The test pattern TP used in the present embodiment is not limited to the example in FIGS. 27A and 27B, and may be variously changed. A modification of the test pattern TP will be described below.

The test pattern according to the present embodiment may further include, in addition to the test pattern TP illustrated in FIGS. 27A and 27B, a reference line formed under a condition different from the condition under which the pair of first marks M1*a* and M1*b*, the second mark M2, and the third mark M3 are formed. The reference line is used to locate the pair of first marks M1*a* and M1*b*, the second mark M2, and the third mark M3. The reference line may be a reference frame surrounding the pair of first marks M1*a* and M1*b*, the second mark M2, and the third mark M3.

Figure 29:
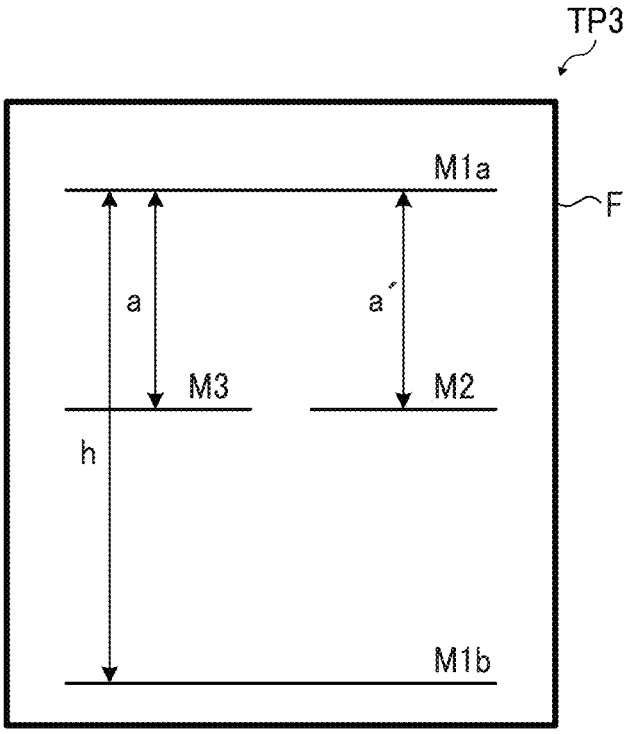
FIG. 29 is a diagram of a test pattern and a reference frame according to an embodiment.

FIG. 29 illustrates an example of a test pattern and a reference frame. A test pattern TP3 illustrated in FIG. 29 includes the test pattern TP illustrated in FIG. 27A and a reference frame F surrounding the test pattern TP. The reference frame F is formed under a condition different from the condition under which the marks of the test pattern TP are formed. For example, the reference frame F is formed with a line having a thickness different from the thickness of the marks of the test pattern TP. This allows the reference frame F to be distinguished from the test pattern TP including the pair of first marks M1*a* and M1*b*, the second mark M2, and the third mark M3 when the positions of the first marks M1*a* and M1*b*, the second mark M2, and the third mark M3 in the captured image are detected.

The image forming apparatus 100 detects the position of the reference frame F after obtaining the captured image. Then, the image forming apparatus 100 detects the positions of the pair of first marks M1*a* and M1*b*, the second mark M2, and the third mark M3 based on the position of the reference frame F. This enables the image forming apparatus 100 to easily detect the positions of the pair of first marks M1*a* and M1*b*, the second mark M2, and the third mark M3 even if the test pattern TP is formed at a deviated position in the captured image.

Embodiment 4

Although, in the image forming apparatus according to Embodiment 1, the two-dimensional sensor CPU mounted in the carriage performs the position detection of the test pattern in the captured image and the ratio calculation, alternatively, the main control board can perform the position detection and ratio calculation.

Figure 30:
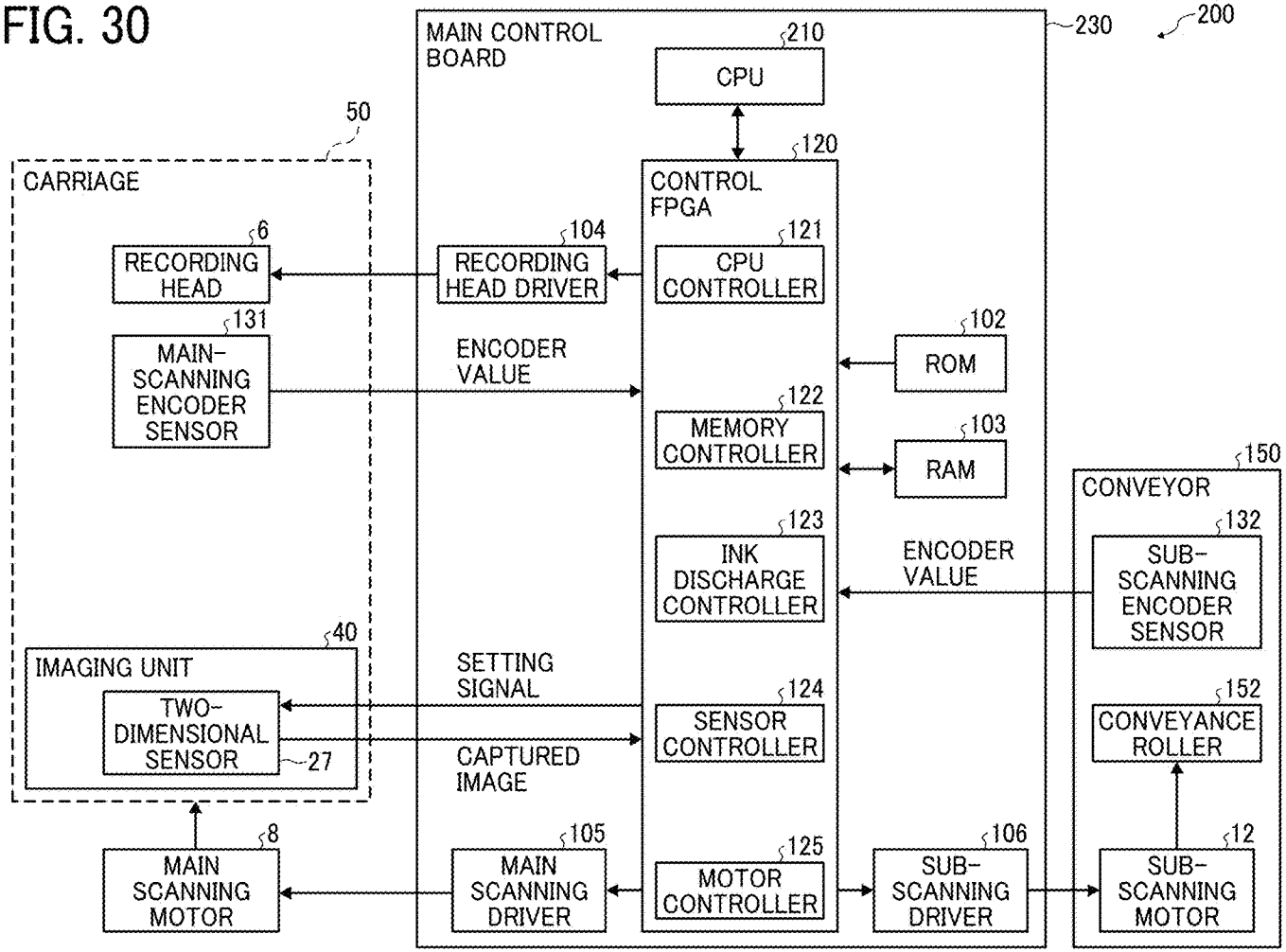
FIG. 30 is a block diagram of a hardware configuration of an image forming apparatus according to Embodiment 4.

A hardware configuration of an image forming apparatus 200 according to the present embodiment will be described referring to FIG. 30. FIG. 30 is a block diagram of the hardware configuration of the image forming apparatus according to Embodiment 4.

As illustrated in FIG. 30, the image forming apparatus 200 according to the present embodiment includes a central processing unit (CPU) 210, the read-only memory (ROM) 102, the random access memory (RAM) 103, the recording head driver 104, the main scanning driver 105, the sub-scanning driver 106, the control Field-Programmable Gate Array (FPGA) 120, the recording head 6, the main-scanning encoder sensor 131, an imaging unit 40, the main scanning motor 8, and the conveyor 150.

The CPU 210, the ROM 102, the RAM 103, the recording head driver 104, the main scanning driver 105, the sub-scanning driver 106, and the control FPGA 120 are mounted on a main control board 230. Meanwhile, the recording head 6, the main-scanning encoder sensor 131, and the imaging unit 40 are mounted on a carriage 50. In addition, the sub-scanning encoder sensor 132, the conveyance roller 152, and the sub-scanning motor 12 are mounted on the conveyor 150.

Configurations except the central processing unit (CPU) 210 and the imaging unit 40 of the image forming apparatus 200 illustrated in FIG. 30 are similar to those of Embodiment 1, and thus redundant descriptions are omitted.

Similar to Embodiment 1, the CPU 210 controls the entire image forming apparatus 200. In particular, the image forming apparatus 200 according to the present embodiment uses the CPU 210 to implement a function of forming the test pattern TP, a function as a distance measurement device, and a function of adjusting a parameter relating to the amount of conveyance of the recording medium P based on the distance.

The imaging unit 40 includes the two-dimensional sensor 27 and captures an image of the test pattern TP (see FIG. 16A) on the recording medium P, controlled by the CPU 210.

The two-dimensional sensor 27 is, for example, a CCD sensor or a CMOS sensor as described above. The two-dimensional sensor 27 captures an image of the test pattern TP under predetermined operation conditions according to various setting signals transmitted via the control FPGA 120 from the CPU 210. Then, the two-dimensional sensor 27 transmits the captured image via the control FPGA 120 to the CPU 210.

Figure 31:
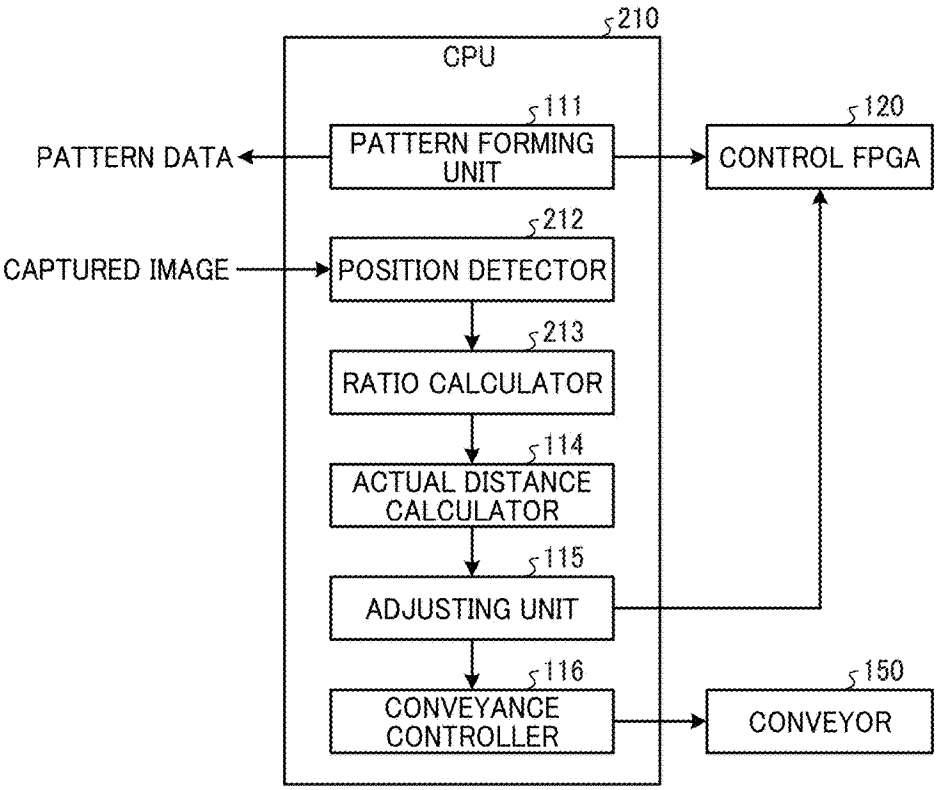
FIG. 31 is a block diagram of a functional configuration of the image forming apparatus according to Embodiment 4.

Referring to FIG. 31, characteristic functions implemented by the CPU 210 of the image forming apparatus 200 will be described. FIG. 31 is a block diagram of a functional configuration of the image forming apparatus according to Embodiment 4.

For example, the CPU 210 uses the RAM 103 as a work area to execute a control program stored on the ROM 102 in order to implement, the functions of the pattern forming unit 111, a position detector 212, a ratio calculator 213, the actual distance calculator 114, the adjusting unit 115, the conveyance controller 116, and the like.

Functions of the pattern forming unit 111, the actual distance calculator 114, the adjusting unit 115, and the conveyance controller 116 are similar to those of Embodiment 1, and thus redundant descriptions are omitted.

Although functions of the position detector 212 and the ratio calculator 213 are similar to those of the position detector 142 and the ratio calculator 143 of Embodiment 1, the position detector 212 and the ratio calculator 213 are implement in the CPU 210, differently from Embodiment 1.

In the image forming apparatus 200 according to Embodiment 4, the sequence of actions relating to adjustment of conveyance amount at the image formation position is similar to that in Embodiment 1 (see FIGS. 21A, 21B, and 21C), and thus redundant descriptions are omitted.

Thus, in the image forming apparatus 200 according to Embodiment 4, the CPU 210 of the main control board 230 performs all of the functions including the position detector 212 and the ratio calculator 213. This configuration attains the effects similar to those attained by the image forming apparatus 100 according to Embodiment 1.

Note that the computer programs performed in the image forming apparatus according to the above-described embodiments are preliminarily installed in a memory device such as a read only memory (ROM). Alternatively, the computer programs executed in the image forming apparatus according to the above-described embodiments can be provided as files being in an installable format or an executable format and stored in a computer-readable recording medium, such as a compact disc read only memory (CD-ROM), a flexible disk (FD), a compact disc recordable (CD-R), and a digital versatile disk (DVD).

For example, aspects of this disclosure can be embodied as a non-transitory recording medium storing a plurality of instructions which, when executed by one or more of processors, cause the one or more of processors to perform the following method. The method includes forming, with a recording head, a pair of first marks while the recording head moves in the first direction and cause the recording head to form a second mark while the recording head moves in the second direction; obtaining a captured image of a test pattern including the pair of first marks and the second mark; detecting a position of the pair of first marks and a position of the second mark in the captured image; calculating a ratio between a distance between the first marks in the captured image and a deviation of the second mark in the captured image; and calculating an actual distance of the deviation of the second mark based on an actual distance between the first marks and the ratio.

Alternatively, the computer programs executed in the image forming apparatus according the above-described embodiments can be stored in a computer connected to a network such as the Internet and downloaded through the network. Alternatively, the computer programs executed in the image forming apparatus can be supplied or distributed via a network such as the Internet.

Programs executed in the image forming apparatus according to the above-described embodiment are in the form of module including the above-described functional units (the pattern forming unit, the position detector, the ratio calculator, the actual distance calculator, the adjusting unit, and the conveyance controller). As the CPU (a processor) reads out the program from the ROM and executes the program, the above-described functional units are loaded and implemented (generated), as hardware, in a main memory. Alternatively, for example, a portion or all of the above-described functions can be implemented by a dedicated hardware circuit.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

For example, although the image forming apparatus described above is a serial head inkjet printer, aspects of this disclosure are applicable to a variety of image forming apparatuses. For example, in a line head inkjet printer, misalignment between recording heads can cause deviations in the landing position of ink. Applying aspects of this disclosure enables accurate calculation of the deviation amount and adjustment of parameters relating to recording medium conveyance in accordance with the deviation amount, thereby improving the image quality.

Additionally, for example, in a tandem electrophotographic image forming apparatus, misalignment between photoconductor drums can cause a positional deviation of an image equivalent to deviations in the landing position of ink in an inkjet printer. Applying aspects of this disclosure enables accurate calculation of the deviation amount of the image in the event of the image position deviation and adjustment of parameters relating to recording medium conveyance in accordance with the deviation amount, thereby improving the image quality.

Additionally, for example, in a thermal printer to perform printing on a recording medium with heat, misalignment or deviation of a thermal head can cause a positional deviation of an image equivalent to deviations in the landing position of ink in an inkjet printer. Applying aspects of this disclosure enables accurate calculation of the deviation amount of the image in the event of the image position deviation and adjustment of parameters relating to recording medium conveyance in accordance with the deviation amount, thereby improving the image quality.

Image formation according to this disclosure includes, in addition to output on recording media such as sheets, formation of boards. Although the image forming apparatus according to the above-described embodiment is a printer, aspects of this disclosure are applicable to other type image forming apparatuses such as copiers and multifunction peripherals (MFPs) having at least two of copying, printing, scanning, and facsimile transmission capabilities.

Each of the functions of the above-described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

What is claimed is:

1. An image forming apparatus comprising:

an image forming device including a recording head to move in a first direction and a second direction opposite the first direction and form a test pattern on a recording medium, the test pattern including a pair of first marks and a second mark, the recording head including a plurality of nozzles to discharge ink, the plurality of nozzles including:

a first nozzle to form one of the pair of first marks; and a second nozzle disposed at a first distance from the first nozzle in a direction of conveyance of the recording medium, the second nozzle to form the other of the pair of first marks;

an imaging device to obtain a captured image of the test pattern; and at least one processor including:

a pattern forming unit configured to cause the recording head to form the pair of first marks while the recording head moves in the first direction and cause the recording head to form the second mark while the recording head moves in the second direction;

a position detector configured to detect a position of the pair of first marks and a position of the second mark in the captured image obtained by the imaging device;

a ratio calculator configured to calculate a ratio between a distance between the pair of first marks in the captured image and a deviation of the second mark in the captured image; and a distance calculator configured to calculate an actual distance of the deviation of the second mark based on the first distance between the first nozzle and the second nozzle and the ratio.

2. The image forming apparatus according to claim 1, further comprising:

a conveyor to convey the recording medium; and a conveyance controller to control the conveyor, wherein the at least one processor further includes an adjusting unit configured to adjust a parameter relating to an amount of conveyance of the recording medium conveyed by the conveyor in accordance with the actual distance of the deviation of the second mark.

3. The image forming apparatus according to claim 2, wherein the image forming device further includes a carriage on which the recording head is mounted, the carriage to reciprocate in the first direction and the second direction.

4. The image forming apparatus according to claim 3, wherein the pair of first marks and the second mark are lines extending in the first direction and the second direction in which the carriage moves.

5. The image forming apparatus according to claim 1, wherein the pattern forming unit causes the recording head to form the second mark with the second nozzle, and wherein the ratio calculator calculates, as the deviation of the second mark in the captured image, a difference between the distance between the pair of first marks in the captured image and a distance from the one of the pair of first marks to the second mark in the captured image.

6. The image forming apparatus according to claim 5, wherein the image forming device further includes a carriage on which the recording head is mounted, the carriage to reciprocate in the first direction and the second direction, and wherein the pair of first marks and the second mark are lines extending in the first direction and the second direction in which the carriage moves.

7. The image forming apparatus according to claim 1, wherein the pattern forming unit causes the recording head to form a reference line under a condition different from a condition under which the pair of first marks and the second mark are formed, the reference line used to locate the pair of first marks and the second mark.

8. The image forming apparatus according to claim 7, wherein the reference line is a frame surrounding the pair of first marks and the second mark.

9. The image forming apparatus according to claim 1, wherein the image forming device further includes a carriage on which the recording head is mounted, the carriage to reciprocate in the first direction and the second direction, wherein the test pattern further includes a third mark, wherein the pattern forming unit causes the recording head to form the third mark while the carriage moves in the first direction, wherein the pattern forming unit causes the recording head to form the second mark and the third mark with a third nozzle disposed at a second distance from the first nozzle in the direction of conveyance of the recording medium, and wherein the ratio calculator calculates, as the deviation of the second mark in the captured image, a difference between the distance from the one of the pair of first marks to the second mark in the captured image and a distance from the one of the pair of first marks to the third mark in the captured image.

10. The image forming apparatus according to claim 9, wherein the pair of first marks, the second mark, and the third mark are lines extending in the first direction and the second direction in which the carriage moves.

11. The image forming apparatus according to claim 9, wherein the pattern forming unit causes the recording head to form a reference line under a condition different from a condition under which the pair of first marks, the second mark, and the third mark are formed, the reference line used to locate the pair of first marks, the second mark, and the third mark.

12. The image forming apparatus according to claim 11, wherein the reference line is a frame surrounding the pair of first marks, the second mark, and the third mark.

13. An image forming apparatus comprising:

an image forming device including a recording head to move in a first direction and a second direction opposite the first direction and form a test pattern on a recording medium, the test pattern including a pair of first marks and a second mark, the recording head including a plurality of nozzles to discharge ink, the plurality of nozzles including:

a first nozzle to form one of the pair of first marks;

a second nozzle disposed at a first distance from the first nozzle in a direction of conveyance of the recording medium, the second nozzle to form the other of the pair of first marks; and a third nozzle disposed at a second distance, different from the first distance, from the first nozzle in the direction of conveyance of the recording medium, the third nozzle to form the second mark;

an imaging device configured to obtain a captured image of the test pattern; and at least one processor including:

a pattern forming unit configured to cause the recording head to form the pair of first marks while the recording head moves in the first direction and cause the recording head to form the second mark while the recording head moves in the second direction;

a position detector configured to detect a position of the pair of first marks and a position of the second mark in the captured image obtained by the imaging device;

a ratio calculator configured to calculate a ratio between a distance between the pair of first marks in the captured image and a distance from one of the pair of first marks to the second mark in the captured image; and a distance calculator configured to calculate an actual distance of a deviation of the second mark based on the first distance, the second distance, and the ratio.

14. A method for calculating an actual distance of a deviation, performed in an image forming apparatus, the method comprising:

forming a pair of first marks on a recording medium, with a first nozzle and a second nozzle of a recording head, while the recording head moves in a first direction, the first nozzle and the second nozzle disposed at a first distance from each other in a direction of conveyance of the recording medium;

forming a second mark on the recording medium while the recording head moves in a second direction opposite the first direction;

obtaining a captured image of a test pattern including the pair of first marks and the second mark;

detecting a position of the pair of first marks and a position of the second mark in the captured image; and calculating an actual distance of a deviation of the second mark based on a distance between the pair of first marks in the captured image, the position of the second mark in the captured image, and the first distance.

* * * * *